US009004102B2

(12) United States Patent
Foo et al.

(10) Patent No.: US 9,004,102 B2
(45) Date of Patent: Apr. 14, 2015

(54) APPARATUS AND METHOD FOR OFFLOADING A HYDROCARBON FLUID

(75) Inventors: Kok Seng Foo, Singapore (SG); Asbjørn Mortensen, Singapore (SG); Alex Kah Keong Tan, Singapore (SG); Toh Tung Wong, Singapore (SG); Wen Sin Chong, Singapore (SG); Teng Kiat Lim, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 785 days.

(21) Appl. No.: 13/236,262

(22) Filed: Sep. 19, 2011

(65) Prior Publication Data

US 2012/0067434 A1 Mar. 22, 2012

Related U.S. Application Data

(60) Provisional application No. 61/451,710, filed on Mar. 11, 2011, provisional application No. 61/385,459, filed on Sep. 22, 2010.

(51) Int. Cl.

| | |
|---|---|
| ***B67D 7/04*** | (2010.01) |
| ***B67D 9/00*** | (2010.01) |
| ***B63B 27/34*** | (2006.01) |
| *B63B 27/24* | (2006.01) |

(52) U.S. Cl.

CPC . *B67D 9/00* (2013.01); *B63B 27/24* (2013.01); *B63B 27/34* (2013.01)

(58) Field of Classification Search

CPC ..... B67D 9/02; B67D 9/00; B63B 27/24; B63B 27/34; B63B 27/10; B63B 27/36

USPC ..... 137/615; 294/81.1, 81.4; 141/382, 387, 141/279, 284; 212/307–311

See application file for complete search history.

(56) References Cited

U.S. PATENT DOCUMENTS 2,818,891 A * 1/1958 Loeser ..... 141/388
2,914,080 A * 11/1959 Silveston ..... 137/236.1

(Continued)

OTHER PUBLICATIONS

European Search Report, including Annex to the European Search Report and European Search Opinion, dated Dec. 27, 2011 and issued in connection with European Patent Application No. EP 11 18 2036. 1.

(Continued)

*Primary Examiner* — John Rivell
*Assistant Examiner* — David Colon Morales
(74) *Attorney, Agent, or Firm* — John P. White; Cooper & Dunham LLP

(57) ABSTRACT

Disclosed are various apparatus and method for transferring a hydrocarbon fluid between two bodies. To this purpose, a transfer skid and transfer hoses are moved from a first body to a second body to be installed thereupon to provide fluid communication between the two bodies. Offloading of hydrocarbon fluid may then take place between the two bodies. Emergency release operation may be triggered during the offloading, where the transfer hoses are disconnected from the transfer skid, and are returned to the first body. Various features of the transfer skid and associated apparatus allow the transfer skid to be installed on the second body with improved mating connections, transfer hoses to be returned to the first body after offloading operation without hydrocarbon fluid leakage, and transfer hoses to disconnect with speed and safety during emergency release operation.

22 Claims, 19 Drawing Sheets

(56) References Cited

U.S. PATENT DOCUMENTS

| | | | | | |
|---|---|---|---|---|---|
| 2,922,446 | A | * | 1/1960 | Sheiry | 141/388 |
| 3,032,082 | A | * | 5/1962 | Vilain | 141/388 |
| 3,217,748 | A | * | 11/1965 | Harper | 137/615 |
| 3,228,421 | A | * | 1/1966 | Sheiry | 137/615 |
| 3,536,023 | A | * | 10/1970 | Bascom et al. | 114/259 |
| 3,567,040 | A | * | 3/1971 | Thomson | 212/242 |
| 3,675,680 | A | * | 7/1972 | Frohlich et al. | 137/615 |
| 3,799,197 | A | * | 3/1974 | Gibbons | 137/615 |
| 3,958,106 | A | * | 5/1976 | Bedford et al. | 235/435 |
| 3,974,864 | A | * | 8/1976 | Fournier et al. | 141/100 |
| 4,168,857 | A | * | 9/1979 | Kloos | 294/81.4 |
| 4,220,177 | A | * | 9/1980 | Gill | 137/615 |
| 4,261,398 | A | * | 4/1981 | Haley | 141/387 |
| 4,388,948 | A | * | 6/1983 | Carminati et al. | 137/615 |
| 4,538,849 | A | * | 9/1985 | Khachaturian et al. | 294/81.1 |
| 5,516,172 | A | * | 5/1996 | Ehrlich | 294/68.1 |
| 5,603,598 | A | * | 2/1997 | Hasegawa et al. | 414/140.3 |
| 6,609,544 | B1 | * | 8/2003 | Williamson | 141/387 |
| 6,637,479 | B1 | * | 10/2003 | Eide et al. | 141/387 |
| 6,820,630 | B2 | * | 11/2004 | Carringer et al. | 137/1 |
| 6,935,390 | B2 | * | 8/2005 | Williamson | 141/387 |
| 7,066,219 | B2 | * | 6/2006 | Poldervaart et al. | 141/387 |
| 7,147,022 | B2 | * | 12/2006 | Le Devehat | 141/387 |
| 7,174,930 | B2 | * | 2/2007 | Poldervaart et al. | 141/387 |
| 2004/0011424 | A1 | * | 1/2004 | Dupont et al. | 141/279 |
| 2007/0289517 | A1 | * | 12/2007 | Poldervaart et al. | 114/230.15 |
| 2009/0065078 | A1 | * | 3/2009 | Le Devehat | 137/615 |
| 2009/0165874 | A1 | | 7/2009 | Pollack et al. | |
| 2009/0272459 | A1 | * | 11/2009 | Biaggi | 141/1 |
| 2010/0147398 | A1 | * | 6/2010 | Thomas et al. | 137/315.01 |

OTHER PUBLICATIONS

Hoog, S., Koch, H., Huhn, R., Frohne, C., Homann, J., Clauss, G., . . . Testa, D. (2009). LNG transfer in harsh environments—introduction of a new concept. *OTC-19866-PP, Offshore Technology Conference*. Houston, Texas.

* cited by examiner

APPARATUS AND METHOD FOR OFFLOADING A HYDROCARBON FLUID

CROSS-REFERENCE TO RELATED APPLICATIONS

This application claims the benefit of of U.S. Provisional Applications Nos. 61/451,710, filed Mar. 11, 2011 and 61/385,459, filed Sep. 22, 2010, the contents of each of which are hereby incorporated by reference into this application.

BACKGROUND

1. Technical Field

Embodiments of the invention relate generally to apparatus and method for transferring a hydrocarbon fluid, e.g. liquefied natural gas (LNG), between two bodies, e.g. a carrier vessel, a floating/fixed hydrocarbon facility.

2. Description of Related Art

Various apparatus and methods for offloading hydrocarbon fluid from a carrier vessel to a floating/fixed hydrocarbon facility, and vice versa, are available but have inherent problems. Offloading hydrocarbon fluid between vessels is also problematic due to unpredictable changes to sea state conditions.

US 2009/0165874 A1 (Pollack et al.) discloses a hydrocarbon transfer system that includes a first structure with a length direction and a transverse direction having a frame carrying a vertical arm with at its end a fluid connecting member for connecting to a second structure which is moored alongside the first structure. The connecting member includes a winch and first guiding elements for engaging with second guiding elements on the second structure by connecting a wire to the winch on one end to the second structure on the other end, and a tension device for moving the vertical arm away from the second structure for tensioning the wire. Due to the inherent rigidity in the above-described members, the system is susceptible to damage if there is a large relative movement between the first and second structures and/or relative dynamic motions are frequent due to severe weather condition. Further, the use of swivels increases a likelihood of leakage during hydrocarbon transfer. This system is also very expensive to manufacture.

US 2010/0147398 A1 (Thomas at al.) discloses a platform and a manifold, the latter being intended to be connected to a fluid tank. The manifold comprises a length of rigid tube defining a pipe of approximately horizontal axis and a length of connecting tube for connection to a transfer line connected to the length of rigid tube. The length of connecting tube is permanently attached to the length of rigid tube and is hinged to the length of rigid tube to allow movement relative to the length of rigid tube between:—a retracted rest position in which the length of connecting tube extends entirely inside the inner edge; and—a first or filling position, in which the free end of the length of connecting tube projects out from the outer edge of the support platform.

In S. Hoog, H. Koch, R. Huhn, C. Frohne, J. Homann, G. Clauss, F. Sprenger, D. Testa: "LNG Transfer in Harsh Environments-Introduction of a New Concept", OTC 19866, Offshore Technology Conference, Houston, USA, 2009, an approach and handling system is disclosed for use when a carrier vessel and terminal are moored in a tandem configuration. A loading bridge is provided at the terminal to handle four transfer pipes simultaneously by a two part header structure which is transferred between the terminal and carrier vessel. The two part header structure combines the following active functionality: simultaneous support and operation of all four flexible pipes with related Quick Connect/Disconnect Couplers (QCDC) and Emergency Release Couplings (ERC); winch driven fine approach, alignment and landing at the LNGC receiving manifold aided; damping of the touch down at the manifold by means of hydraulic dampeners; operation (closing and disconnection) of all four QCDCs; operation (closing and disconnection) of all four ERCs in an Emergency Shut-Down (ESD) situation; remote controlled departing of both header parts (and subsequent lifting of the upper means of pre-tensioned wires suspended from the loading bridge) in an ESD situation. Normally, the carrier vessel would need to move away from the terminal and hence, in this system, before the carrier vessel can move away to safety, the header structure has to be lifted clear to prevent collision with parts of the carrier vessel.

SUMMARY

Embodiments of the invention disclose various apparatus and method for transferring a hydrocarbon fluid between two bodies which may be floating and/or fixed.

According to one embodiment, a transfer skid is movable from a first body to a second body to be installed thereupon to facilitate hydrocarbon fluid transfer to and from the first and the second bodies. The transfer skid may comprise a skid frame, and several pipes which are separately attached to the skid frame to allow manipulation of the pipes independently of one another. Each of the pipes has a first end and a second distal end, where a coupler is provided at the first end to connect to the second body upon installing the transfer skid, and an emergency release coupling is provided at the second end of the each of the pipes. A transfer hose is interposed or connected between the emergency release coupling and the first body.

Upon installing the transfer skid onto the second body, the coupler is disposed inboard the second body while the emergency release coupling is disposed outboard of the second body, since the coupler and the emergency release coupling are arranged spaced apart by the pipes connected therebetween.

During an emergency release operation, the emergency release coupling disconnects the transfer hose from the transfer skid installed at the second body by way of detaching a part of the emergency release coupling. The detached part of the emergency release coupling, together with the corresponding transfer hose attached thereto, is allowed to fall away from the transfer skid due to gravity force. As the detached part of the emergency release coupling is supported by a lifting device, which is provided on the first body, to limit the fall of the detached part of the emergency release coupling, the detached part of the emergency release coupling and its corresponding transfer hose are prevented from falling into the water, and are lifted and returned to the first body.

Other features and advantages of the invention will be apparent from the following description and accompanying drawings.

BRIEF DESCRIPTION OF THE DRAWINGS

Embodiments of the invention are disclosed hereinafter with reference to the drawings, in which.

DETAILED DESCRIPTION

Figure 1:
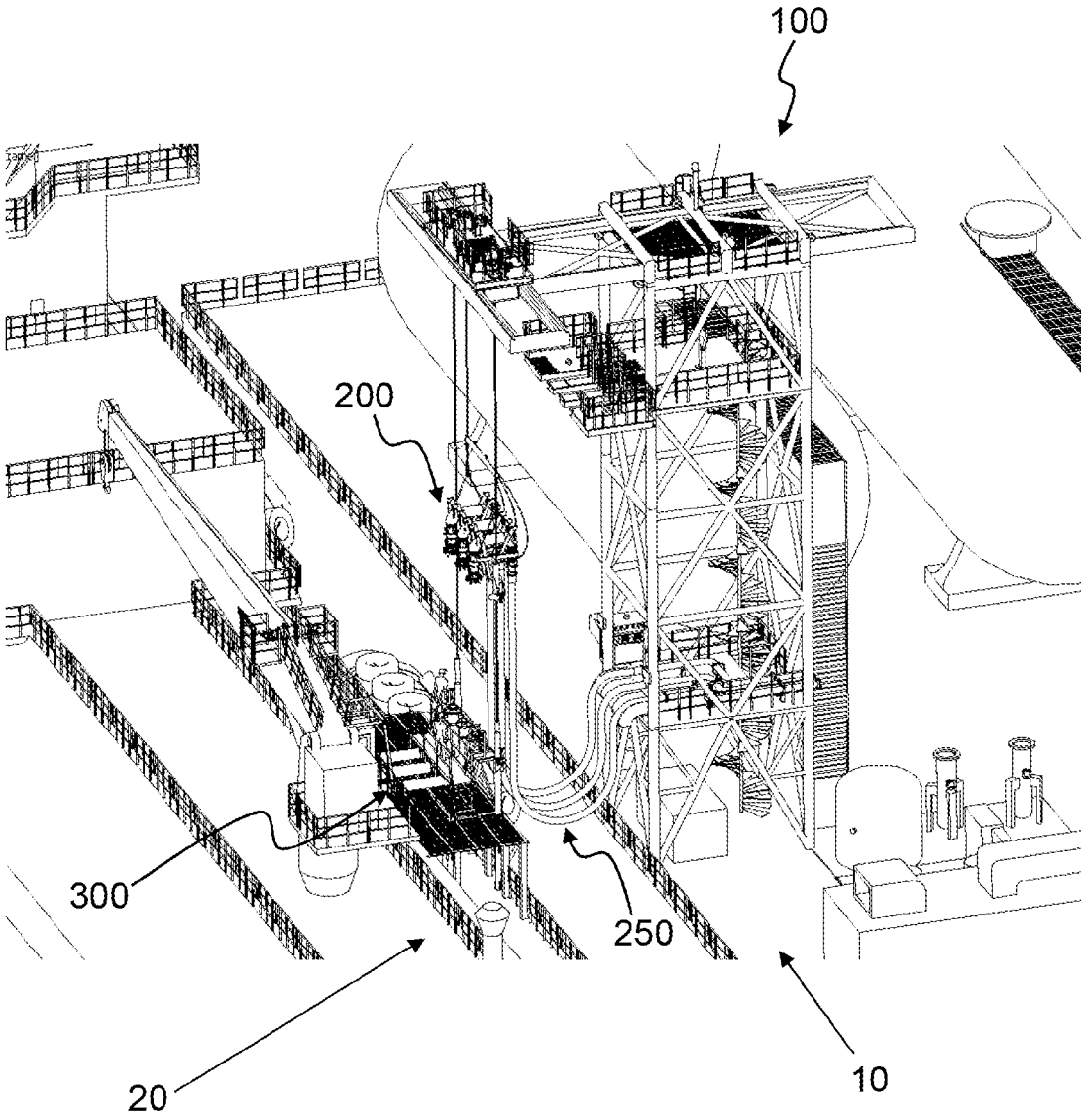
FIG. 1 illustrates an offloading system according to one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Embodiments of the invention provide an apparatus and method for offloading or transferring a hydrocarbon fluid between two bodies in ship-to-ship, ship-to-shore, and shore-to-ship applications. Examples of the two bodies involved include, but are not limited to, a carrier vessel, a barge, a receiving terminal, a floating/fixed hydrocarbon processing facility, offshore platforms. Hydrocarbon fluid to be transferred includes, but is not limited to, liquefied natural gas (LNG) and liquefied petroleum gas (LPG).

FIG. 1 illustrates an offloading system according to one embodiment of the invention. Particularly, FIG. 1 includes a mast 100, a transfer skid 200, transfer or flexible hoses 250 and a pipe deck 300 which are being arranged to transfer hydrocarbon fluid from a carrier vessel 20 (also referred to as "second body") to a floating/fixed hydrocarbon processing facility 10 (also referred to as "first body") or vice versa.

Figure 2:
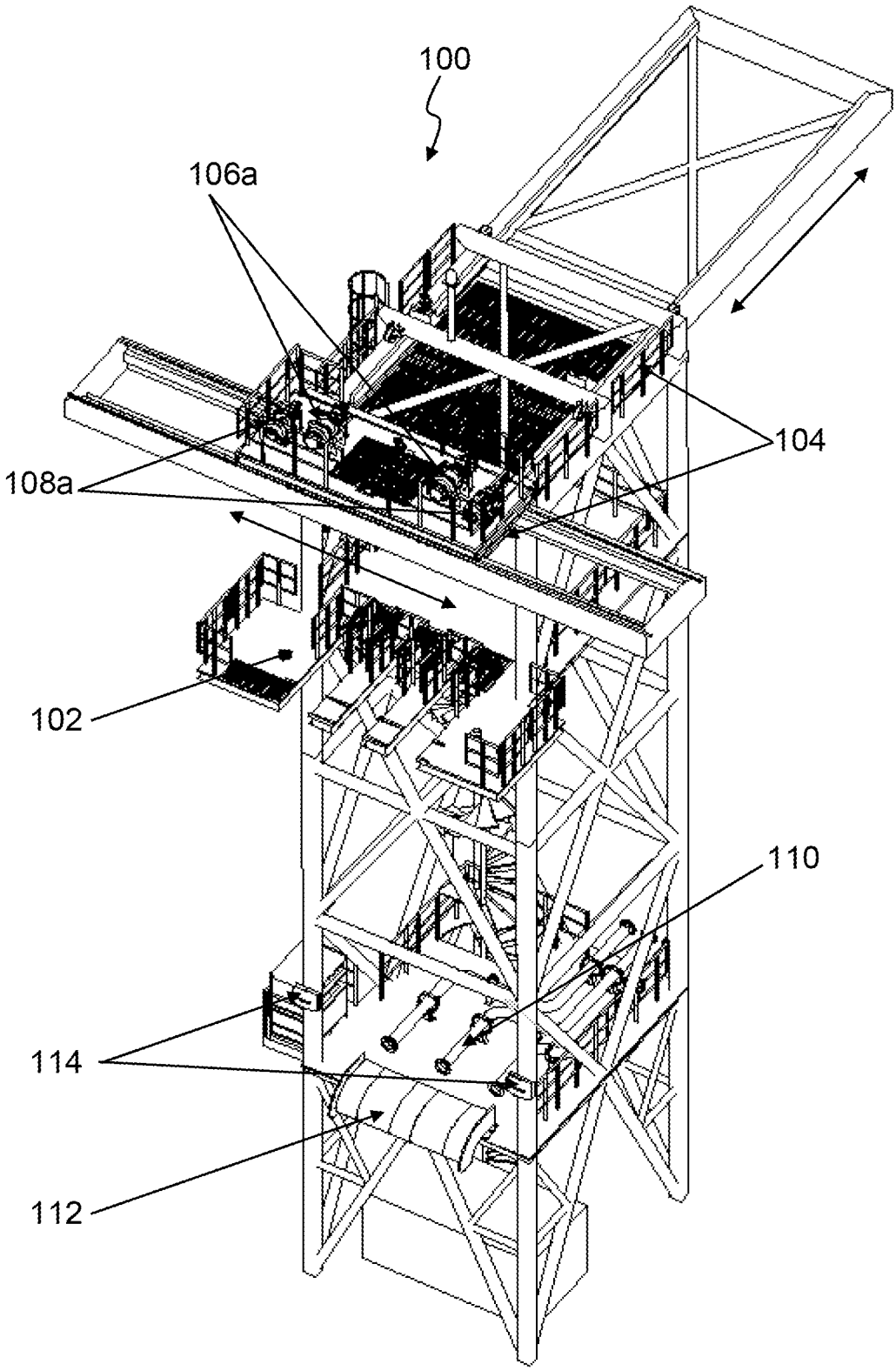
FIG. 2 illustrates a mast as shown in FIG. 1.

FIG. 2 illustrates a mast 100 as shown in FIG. 1. The mast 100 may be provided as a tower structure (or other suitable forms including but not limited to A-frames, vertical frames) which houses various utilities for handling the transfer skid 200 and transfer hoses 250. A parking platform 102 may be provided on the mast 100 to support or house the transfer skid 200 in a parking position. The parking platform 102 may be arranged at a suitably elevated level above a main deck of the carrier vessel 20 so that when the transfer skid 200 is arranged in a parking position, the transfer hoses 250 connected to the transfer skid 200 may be allowed to hang in a catenary form (i.e. naturally free-hanging). A lifting device may be provided on the mast 100 to manipulate or transfer the transfer skid 200 to and from the two bodies 10, 20. For example, a crane or an X-Y gantry crane 104 (e.g. platform arrangement driven by rack and pinion drives for longitudinal and transverse (X-Y) movement), and winches for hoisting may be provided on top of the mast 100. For example, four winches may be provided on top of the mast 100, where two of the winches, i.e. main hoist winches 106*a*, for controlling a main hoist may be arranged for hoisting the transfer skid 200 while the remaining two winches, i.e. guide wire winches 108*a*, for controlling a guide wire hoist, allows manipulation of guide wires during installing of the transfer skid 200 onto a pipe deck 300. The winches may be hydraulic-controlled with control panel and joysticks arranged on the parking platform 102 of the mast 100. The winches may also be equipped with a pressure relief valve and mechanical clutch for overloading protection. In addition, winch reels may have a mechanical guiding device to keep each wire in the groove when it is slack. In anticipation of relative heave motion during offloading operation, the guide wire winches 108*a* may provide a constant tension to the guide wires.

Fixed hard pipe manifolds 110 may be provided at the mast 100 to link the transfer hoses 250 to the process facilities on the vessel or terminal at which the mast 100 is located. Saddles 112 may be provided on the mast 100 for maintaining minimum bending radius for resting transfer hoses 250. A monitoring system may be provided to detect changes in relative positions of the two bodies 10, 20 and thereby allowing a trigger of an emergency alarm. Particularly, position monitoring interrogators 114 may be mounted on the mast 100 and transponders 224 (see FIG. 3B) may be mounted on the transfer skid 200. The interrogators 114 and transponders 224 may be connected to a computer system which may determine the presence of an emergency situation based on readings taken from the interrogators 114 and transponders 224, and initiate an emergency alarm if a change in relative positions of the two bodies 10, 20 breaches a predetermined threshold. Alternatively, an emergency alarm may be triggered by hardwires or cables which connect to the two bodies 10, 20. In the event the two bodies 10, 20 drift apart beyond a predetermined allowable working envelope during an offloading operation, the cables are pulled by the drifting away from the two bodies 10, 20 to trigger an emergency alarm. Hydraulic power units (HPU) may be provided on the floating/fixed hydrocarbon facility 10 to power various utilities e.g. gantry crane, emergency release system, provided thereon.

It is to be appreciated that the above features may be modified in certain other embodiments. For example, an elevated platform may be located on the floating/fixed hydrocarbon facility 10 to house and support the transfer skid 200, a lifting device may be provided on the deck of the floating/fixed hydrocarbon facility 10 or at an elevation to manipulate the transfer skid 200 and transfer hoses 250 between two bodies 10, 20, a guiding device may be provided on the deck of the floating/fixed hydrocarbon facility 10 or at an elevation to guide the transfer skid 200 as it is being manipulated.

Figure 3A:
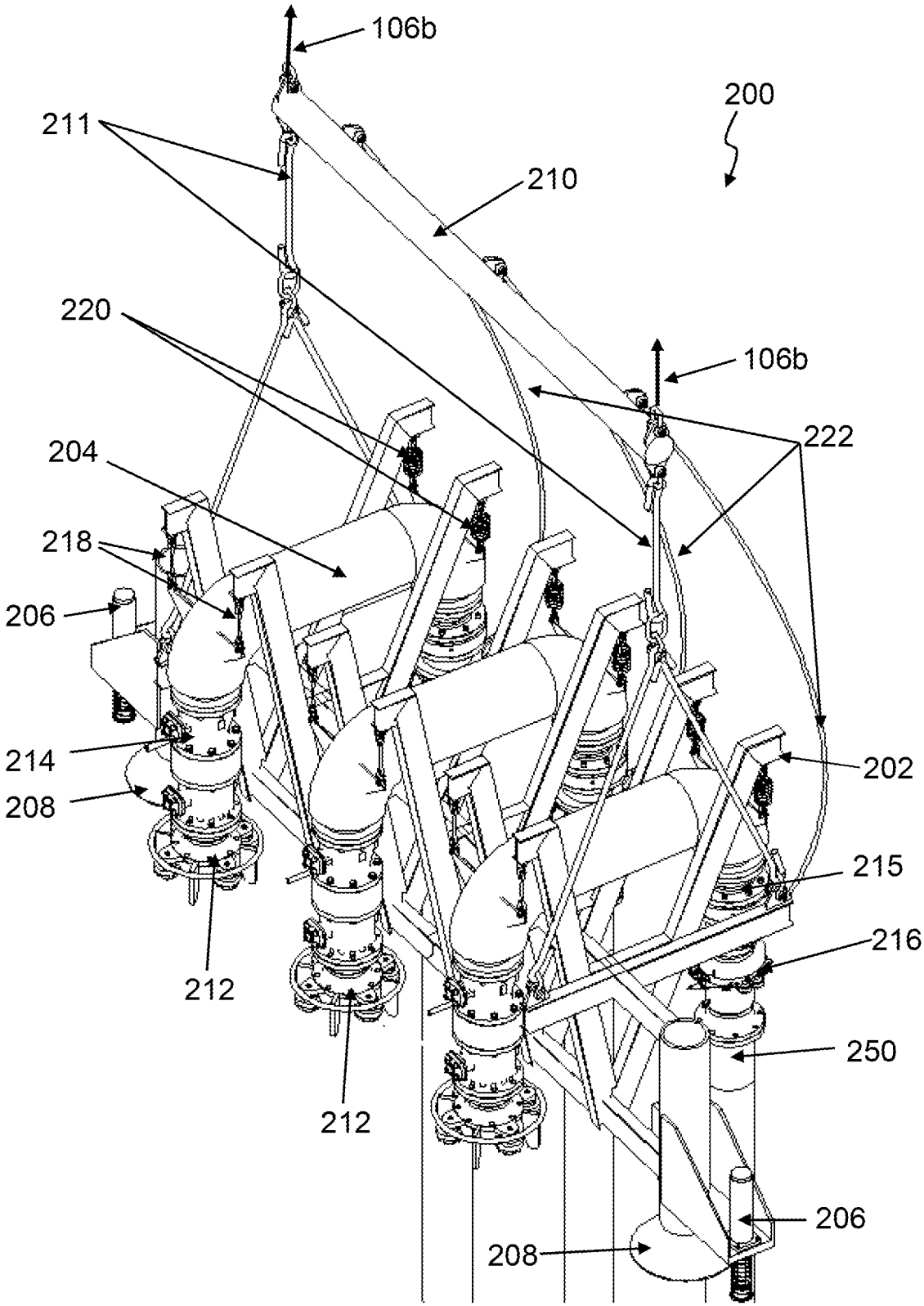
FIGS. 3A and 3B illustrate various views of a transfer skid as shown in FIG. 1.
Figure 3B:
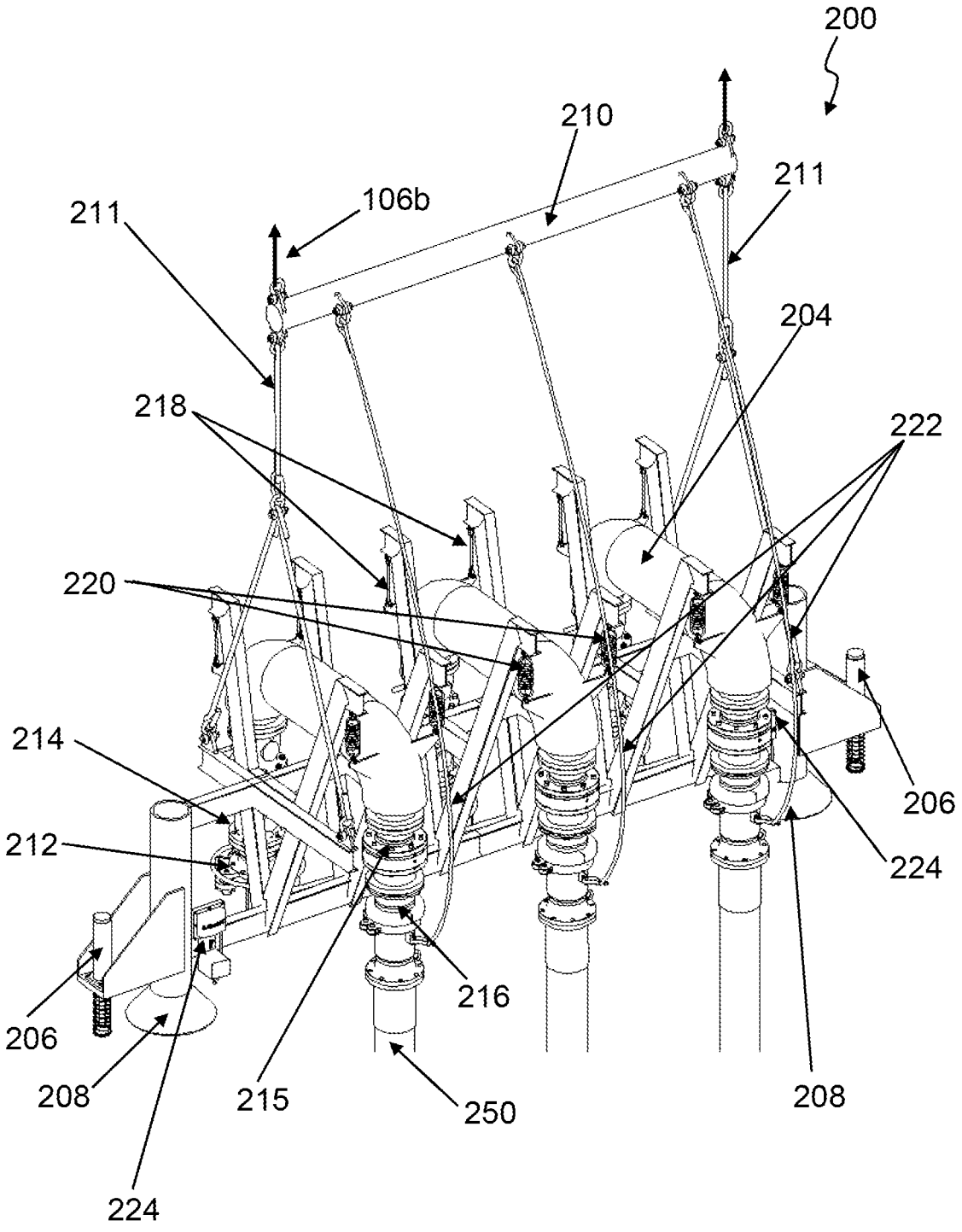

FIGS. 3A and 3B illustrate a transfer skid 200 as shown in FIG. 1. The transfer skid 200 includes a skid frame 202 for supporting a plurality of pipes 204. At two ends of the skid frame 202, shock absorbers 206 and guide funnels 208 may be positioned thereto. The shock absorbers 206 are constructed and arranged to dampen impact during installing of the transfer skid 200. The guide funnels 208 are constructed and arranged to guide the transfer skid 200, in cooperation with guide wires 108*b*, to a desired position during installing. The skid frame 202 is supported by a spreader beam 210 by way of skid hoist wires 211. Quick release connectors may be provided to allow disconnection of the transfer skid 200 from the spreader beam 210. The spreader beam 210 is supported by a lifting device on the floating/fixed hydrocarbon facility 10 by way of main hoist wires 106*b*.

In the embodiment of FIGS. 3A and 3B, the skid frame 202 includes three pipes 204, where two pipes may be used for hydrocarbon fluid transfer and one pipe may be used for vapour return. It is to be appreciated that other configurations of the transfer skid 200 with other number of pipes 204 (e.g. two, three, or more) may be used with suitable modifications. Each pipe 204 may be of an inverted U-shape and provided with insulation. At a first end of each pipe, a Quick Connect/Disconnect Coupler 212 (QCDC) is provided to connect to a manifold flange on a carrier vessel 20. While QCDCs 212 are presently illustrated and described, it is to be appreciated that other forms of couplers, whether a manual device e.g. bolted connection, or an automatic device, used to connect the transfer skid 200 to the manifold of a carrier vessel 20, may be used in certain other embodiments. At least one valve 214, e.g. double block single bleed valve, single block double bleed valve, may be interposed or connected between the first end of each pipe 204 and the corresponding QCDC 212, or may be integrated with the corresponding QCDC 212. At a second (distal) end of each pipe 204, an Emergency Release Coupling 216 (ERC) is provided to connect to a cryogenic transfer hose 250 which is flexible. A swivel 215 (optional) may be interposed or connected between the ERC 216 and the second end of each pipe 204 to allow rotational movement of the transfer skid 200 relative to the carrier vessel 20 after the transfer skid 200 is installed on the carrier vessel 20.

The pipes 204 may be separately attached or supported to the skid frame 202 by way of one or more adjustable connections. In the embodiment illustrated in FIGS. 3A and 3B, two support wires 218 attach one portion (which is closer to the QCDC) of each pipe 204 to the skid frame 202. The support wires may be taut but are adjustable to allow each pipe 204 to be repositioned relative to the skid frame 202 and also independently of the other pipes 204. Hence, each pipe 204 can be manipulated or repositioned independently of other pipes 204 to ensure improved mating of a pipe 204 with a connection flange of a carrier vessel even if various connection flanges of the carrier vessel are unevenly located due to uneven deck or for other reasons. FIGS. 3A and 3B also show two springs 220 or resilient means attaching another portion (which is closer to the ERC) of each pipe 204 to the skid frame 202. When the transfer skid 200 is installed at the carrier vessel 20, i.e. the QCDC 212 is connected to the flange at the carrier vessel 20, the springs 220 or resilient means prevent excessive bending load in the QCDC 212 and the flange and thereby preventing leakages resulting from excessive bending loads. While FIGS. 3A and 3B illustrate each pipe 204 is attached to the skid frame 202 by four wires and/or springs, it is to be appreciated that other configurations and number of wires and/or springs (e.g. four springs) may be used in certain other embodiments. Also, while FIGS. 3A, 3B and other drawings illustrate rigid pipes 204 being used, it is to be appreciated that flexible pipes or hoses can be used in certain other embodiments.

The ERC 216 may be formed of a pair of mating parts or connectors (hereinafter ERC1 216*a* and ERC2 216*b* respectively) which are normally securely engaged to each other when the transfer skid 200 is disposed in a parked position and during offloading operation. The mating parts may be activated to disconnect from each other within a predetermined time during an emergency release operation. ERC1 216*a* connects to a transfer hose 250 which is to connect, directly or via other connectors or pipes 204, to a hydrocarbon processing facility 10, e.g. storage, gas processing, regasification. ERC2 216*b* is interposed or connected between ERC1 216*a* and the pipe 204, directly or indirectly through a swivel 215. A slack ERC hoist wire 222 attaches each ERC1 216*a* to a common spreader beam 210.

As would be appreciated from the above, the functions of the transfer skid 200 include, but are not limited to, providing a connection interface for hydrocarbon fluid transfer between two bodies 10, 20 and allowing simultaneous transfer of multiple transfer hoses 250 with a single lift.

Figure 4:
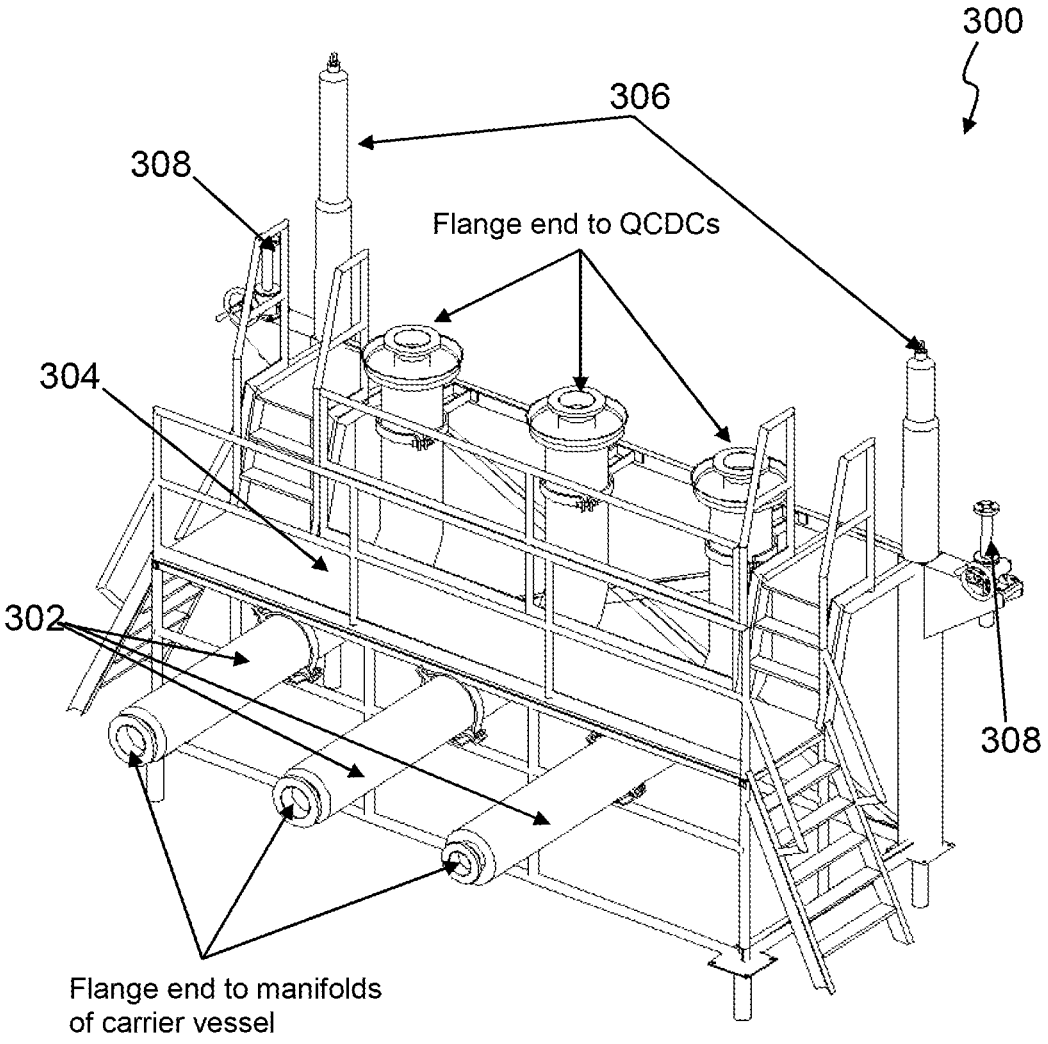
FIG. 4 illustrates a pipe deck as shown in FIG. 1.

FIG. 4 illustrates a pipe deck 300 which functions as a connecting interface between the manifolds of a carrier vessel 20 and the transfer skid 200. The carrier vessel 20 has manifolds which are ducts for facilitating hydrocarbon fluid transfer from/to the carrier vessel 20. The pipe deck 300 includes pipe spools 302. One end of each pipe spool 302 is provided with a flange to connect to a manifold of the carrier vessel 20. The distal end of each pipe stool is provided with a flange to connect to a QCDC 212 of the transfer skid 200. By installing a pipe deck 300 on a carrier vessel 20, the positions of the manifolds of the carrier vessel 20 are effectively re-orientated or re-positioned towards an outer edge of the carrier vessel 20, thereby allowing the ERCs 216 to be positioned outboard of the carrier vessel 20 once the transfer skid 200 is installed on the carrier vessel 20.

The pipe deck 300 may be provided with a working platform 304 for manpower access. The pipe deck 300 may also be provided with guide posts 306 for guiding the transfer skid 200 when the transfer skid 200 is being installed onto the pipe deck 300. Jack screws 308 or other suitable adjustment devices may also be provided to allow fine adjustments of the installed transfer skid 200 prior to securing or locking the QCDCs 212 of the transfer skid 200 in position on the carrier vessel.

Preparation for Offloading Operation & Offloading Operation

A sequence for installing a pipe deck 300 on a carrier vessel 20, connecting a transfer skid 200 to the carrier vessel 20 and offloading hydrocarbon fluid is described with reference to FIGS. 5 to 16.

Figure 5:
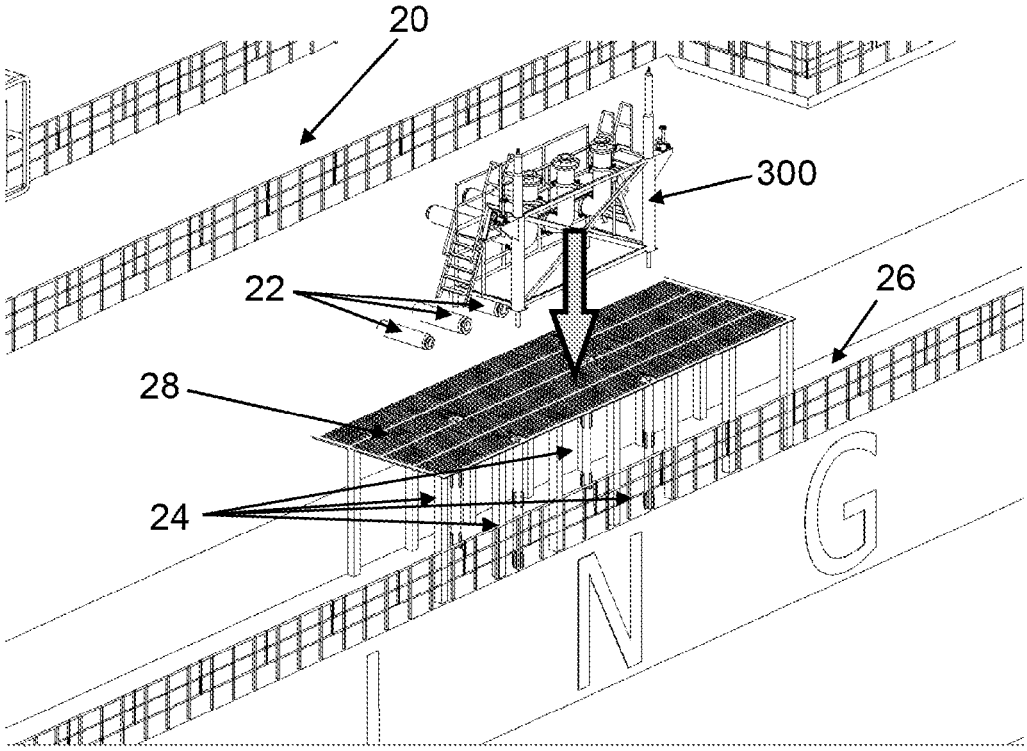
FIG. 5 illustrates a pipe deck being lowered onto a grating deck of a carrier vessel.
Figure 6:
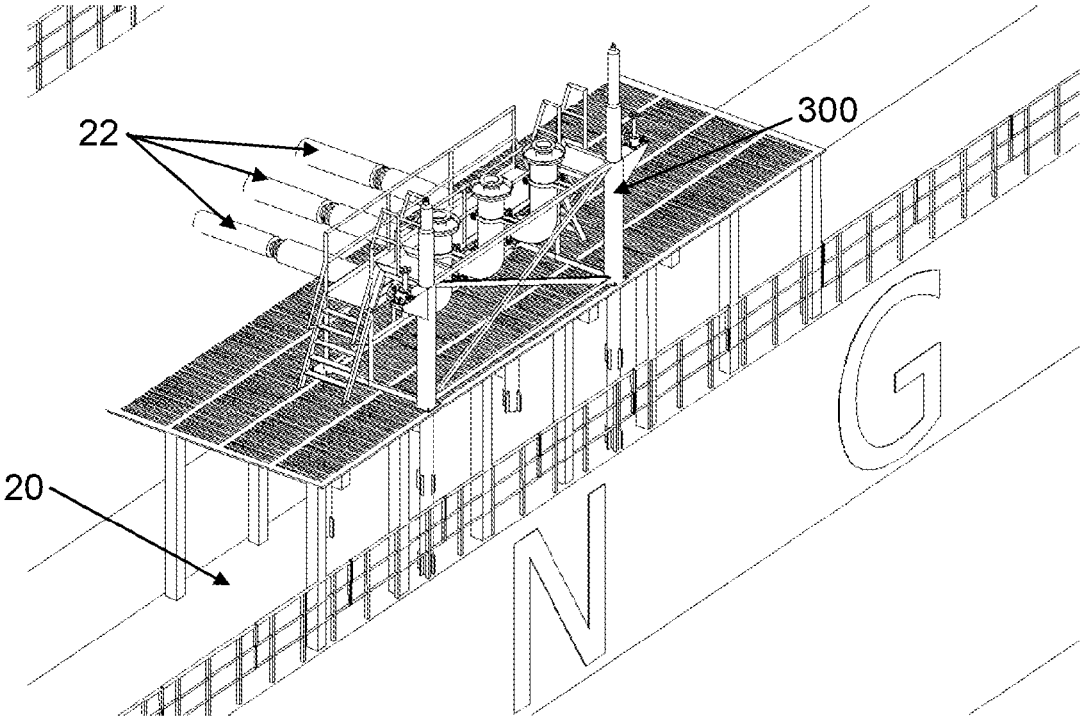
FIG. 6 illustrates pipe spools of the pipe deck secured to the manifolds of the carrier vessel.

FIGS. 5 and 6 illustrate installation of a pipe deck 300 on a carrier vessel 20. In particular, FIG. 5 illustrates a pipe deck 300 being lowered onto a grating deck of a carrier vessel 20; FIG. 6 illustrates pipe spools 302 of the pipe deck 300 secured to the manifolds 22 of the carrier vessel 20. Installation of a pipe deck 300 on a carrier vessel 20 may be carried out prior to each hydrocarbon fluid transfer operation. Alternatively, the pipe deck 300 may remain installed on the carrier vessel 20 in between hydrocarbon fluid transfer operations if, for example, the carrier vessel 20 is on a long term charter.

In certain applications, the carrier vessel 20 may require slight modification prior to installing a pipe deck 300, e.g. adding strengthening columns 24 from the main deck 26 of the carrier vessel 20 to the grating deck 28 as the grating deck 28 is normally not designed to be subject to high loadings and impact forces. The purpose of the strengthening columns is to transfer the loadings from the pipe deck 300 to the main deck of the vessel as the pipe deck 300 is to be installed and seated on the grating deck 28.

Figure 7:
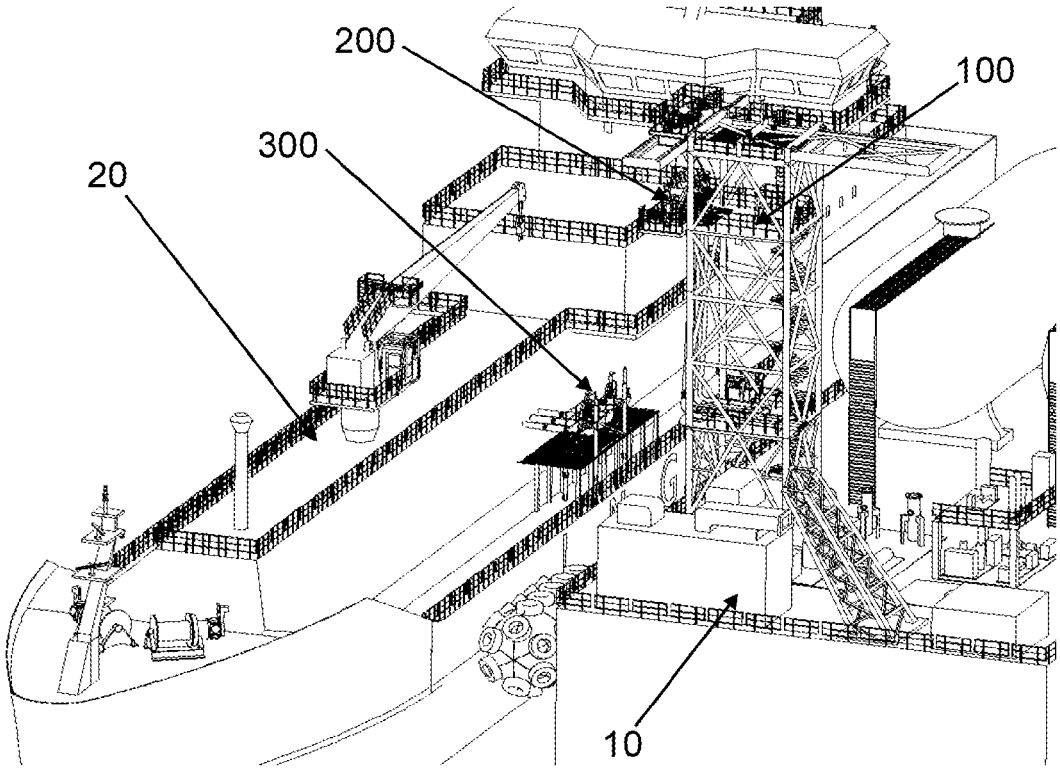
FIG. 7 illustrates a carrier vessel being moored in position in preparation for offloading operation.

FIGS. 7 to 13 illustrate various stages of connecting a transfer skid 200 to a carrier vessel 20 in preparation for offloading operation. FIG. 7 illustrates a carrier vessel 20 being moored to a floating/fixed hydrocarbon facility 10 in preparation for offloading operation. The carrier vessel 20 may be separated by a safe distance from the floating/fixed hydrocarbon facility 10 by floating pneumatic fenders. After the carrier vessel 20 is moored in position and depending on operator requirement and preference, mooring load monitoring may be set up, weather and environment conditions may be monitored to ensure that an offloading operation may commence safely.

Figure 8:
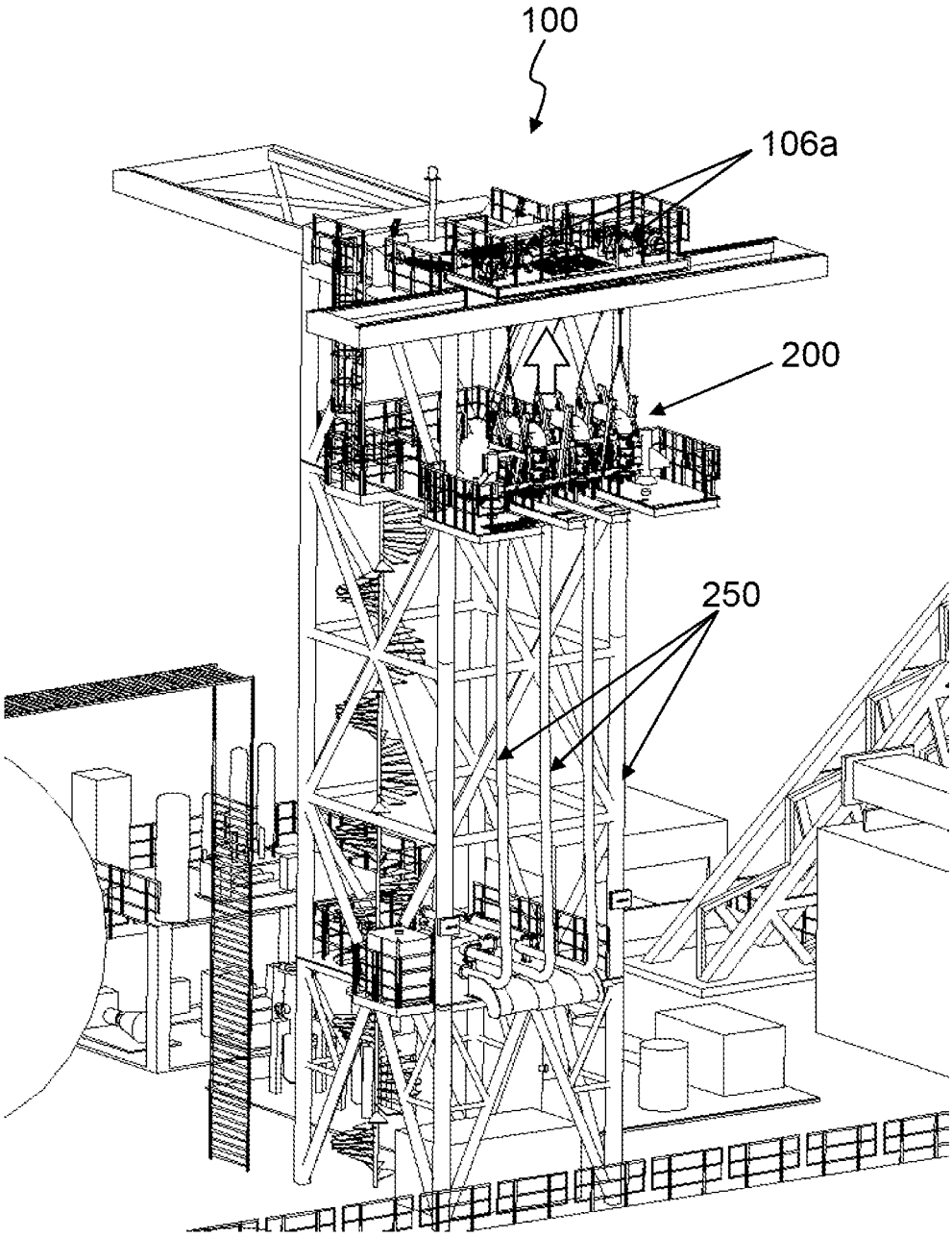
FIG. 8 illustrates a transfer skid being lifted from a parking position.
Figure 9:
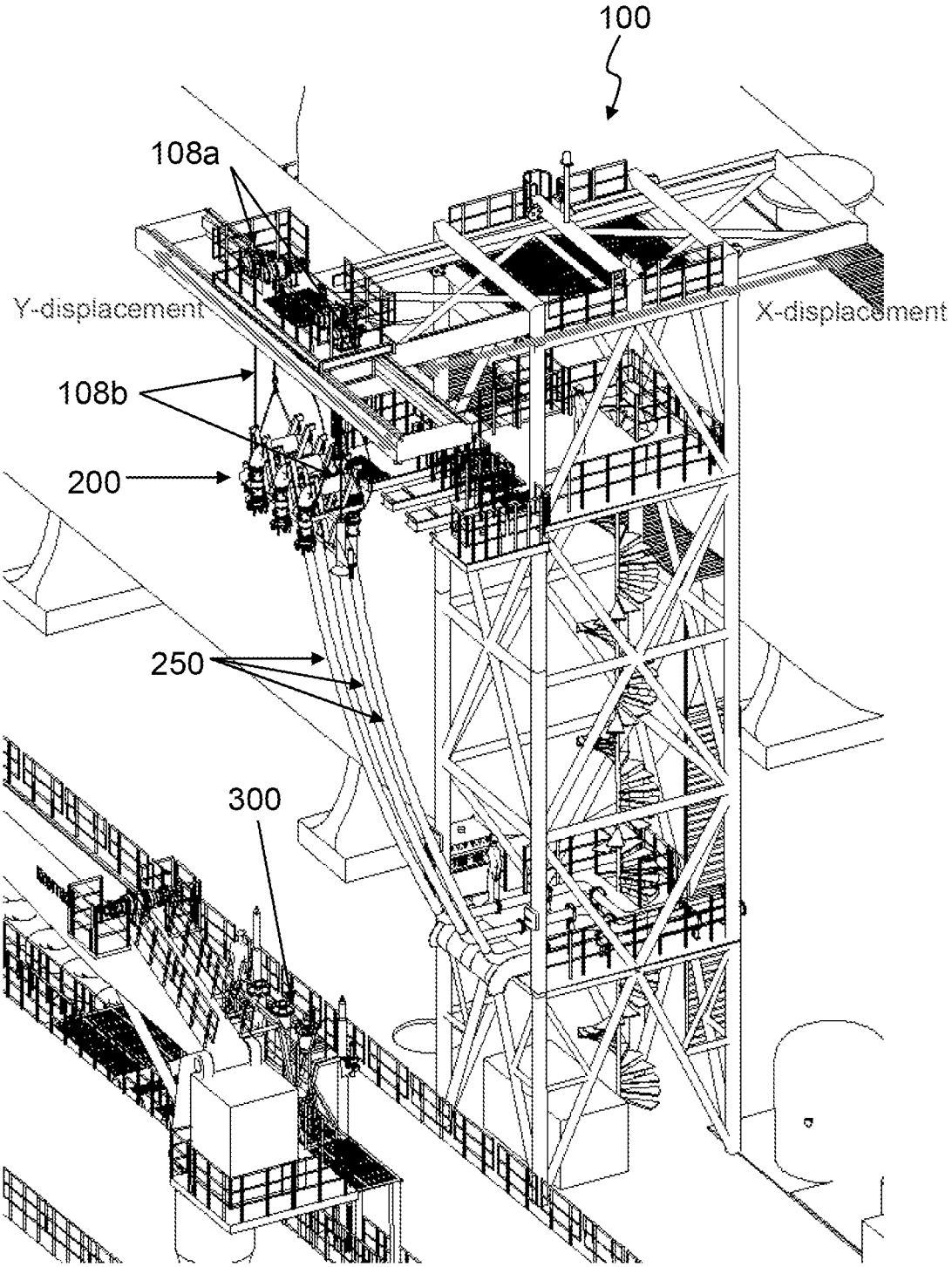
FIG. 9 illustrates the transfer skid being lifted above the pipe deck on the carrier vessel.
Figure 10:
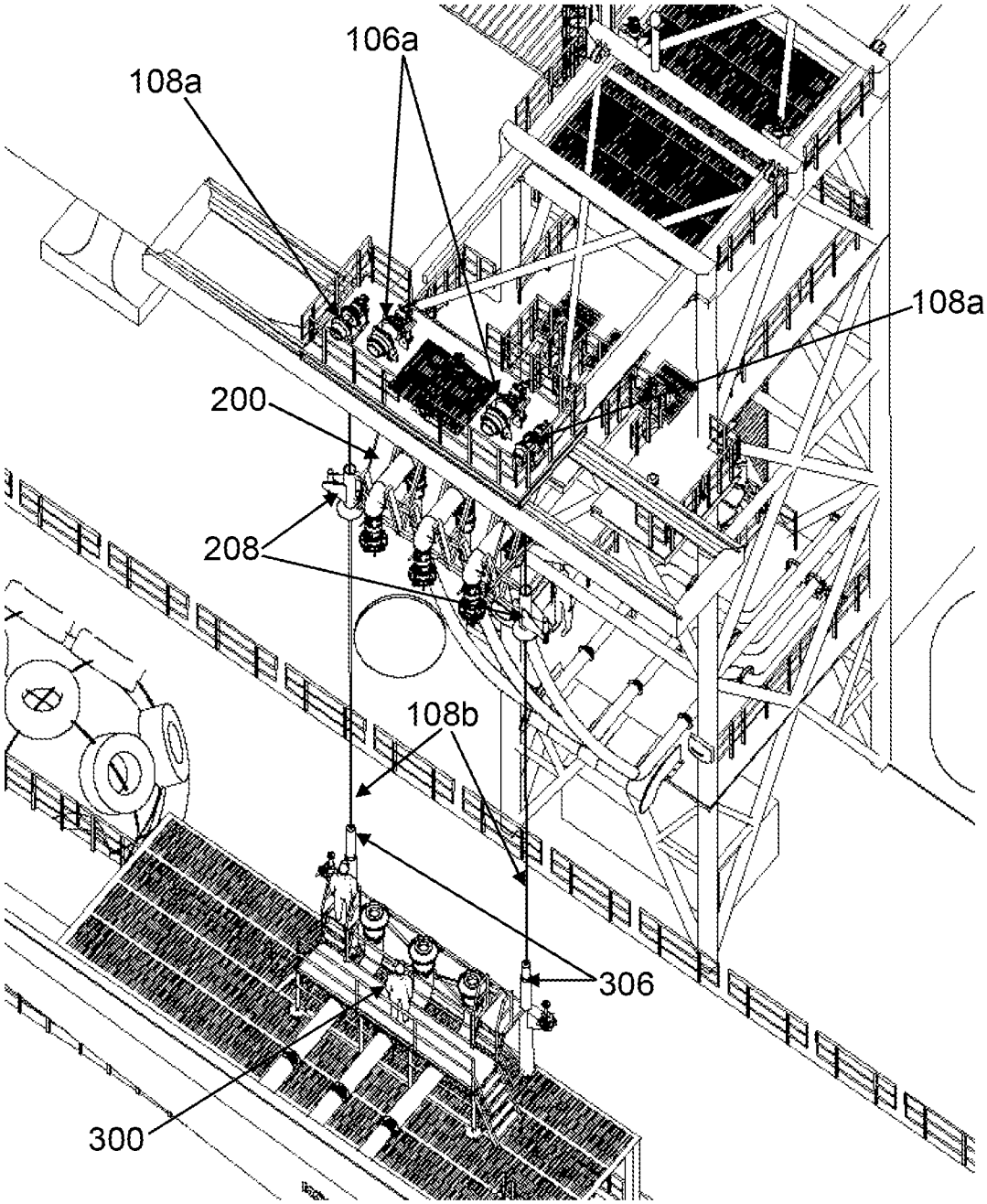
FIG. 10 illustrates guide wires attached to guide posts of the pipe deck.

FIG. 8 illustrates a transfer skid 200 being lifted from a parking position at the floating/fixed hydrocarbon facility 10. At the parking position, the transfer skid 200 is supported on a parking platform 102 while the transfer hoses 250 are arranged to hang from the parking platform 102. The transfer skid 200 may be hoisted from the parking platform 102 by a lifting device, e.g. main hoist winches 106*a* on top of the mast 100. A guiding device may be activated, e.g. guide wires 108*b* may reeled out from the top of the mast 100 towards the parking platform 102 to be attached to each guide funnel 208 of the transfer skid 200 via a catch ball (see FIG. 9). After the guide wires 108*b* are secured to the transfer skid 200, the lifting device may move the hoisted transfer skid 200 towards the carrier vessel 20 (e.g. a gantry crane may move outwards in the X direction towards the carrier vessel 20). The hoisted transfer skid 200 is then positioned approximately directly above the pipe deck 300 on the carrier vessel 20. For this purpose, the gantry crane may also be adjusted in a combination of X and the Y directions.

Once the transfer skid 200 is positioned approximately above the pipe deck 300, the guide wires 108*b* may be lowered towards the pipe deck 300 on the carrier vessel 20. Crew members positioned at the working platform 304 of the pipe deck 300 may grab the catch ball at the tips of the guide wires 108*b* and attach each guide wire 108*b* to each guide post 306 of the pipe deck 300 (see FIG. 10). As the sea state may create a relative motion between the carrier vessel 20 and the floating/fixed hydrocarbon facility 10; the guide wires 108*b* will act as a guide to direct the funnel 208 of the transfer skid 200 towards the guide post 306 of the pipe deck 300. Once the guide wires 108*b* are secured to the guide post 306 of the pipe deck 300, the guide winches 108*a* maintain a constant tension in the guide wires 108*b*. The transfer skid 200 may then be lowered towards the pipe deck 300 where the guide posts 306 will be inserted into the respective funnels 208, thereby guiding the transfer skid 200 to land onto the pipe deck 300.

Figure 11:
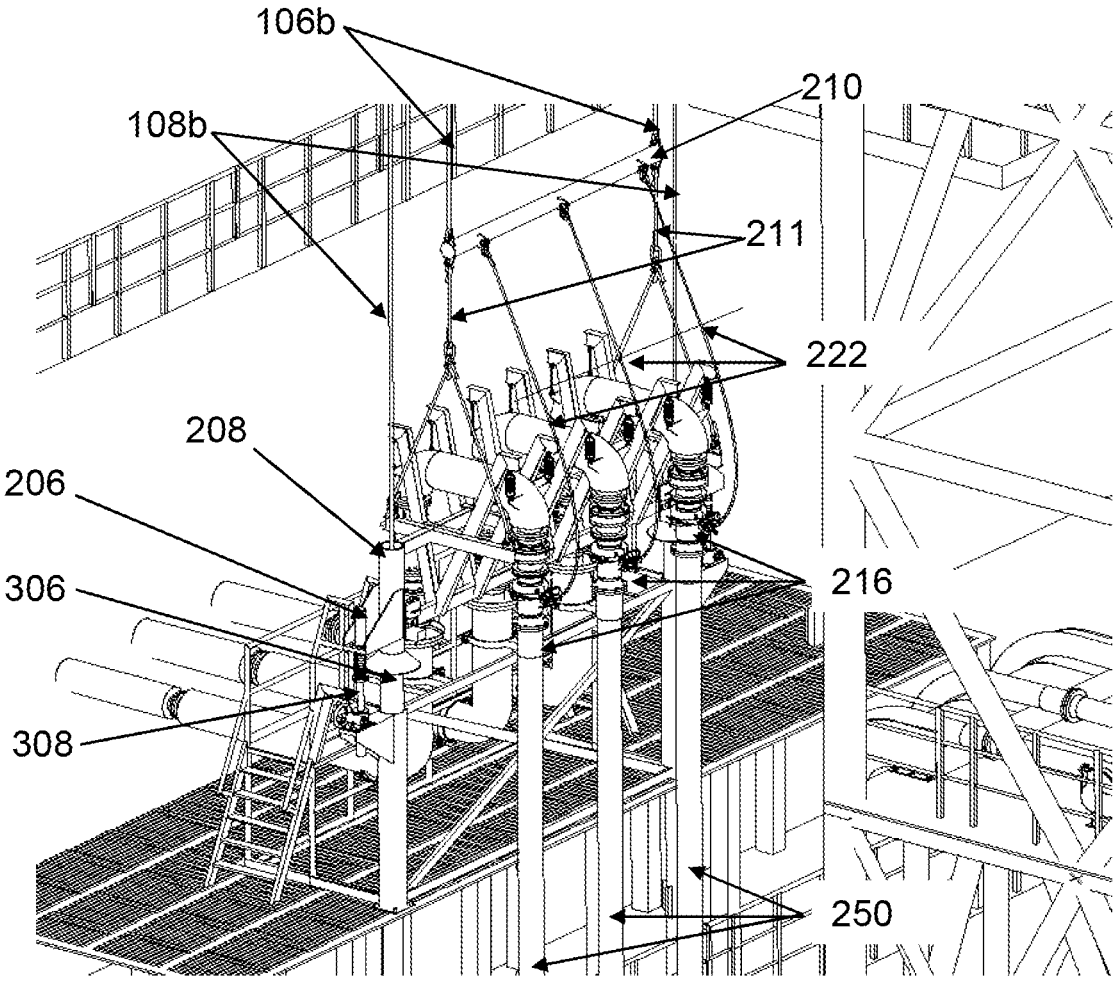
FIG. 11 illustrates the transfer skid being installed onto the pipe deck.

During landing, the shock absorbers 206 attached to the transfer skid 200 may collide with the jack screws 308 attached to the pipe deck 300 (see FIG. 11). The collision impact from landing of the transfer skid 200 may be significantly reduced by the shock absorbers 206 at both sides of the transfer skid 200. This would prevent both the transfer skid 200 and pipe deck 300 from being damaged by impact shock during landing due to sudden relative heave motion between the carrier vessel 20 and the floating/fixed hydrocarbon facility 10.

Figure 12:
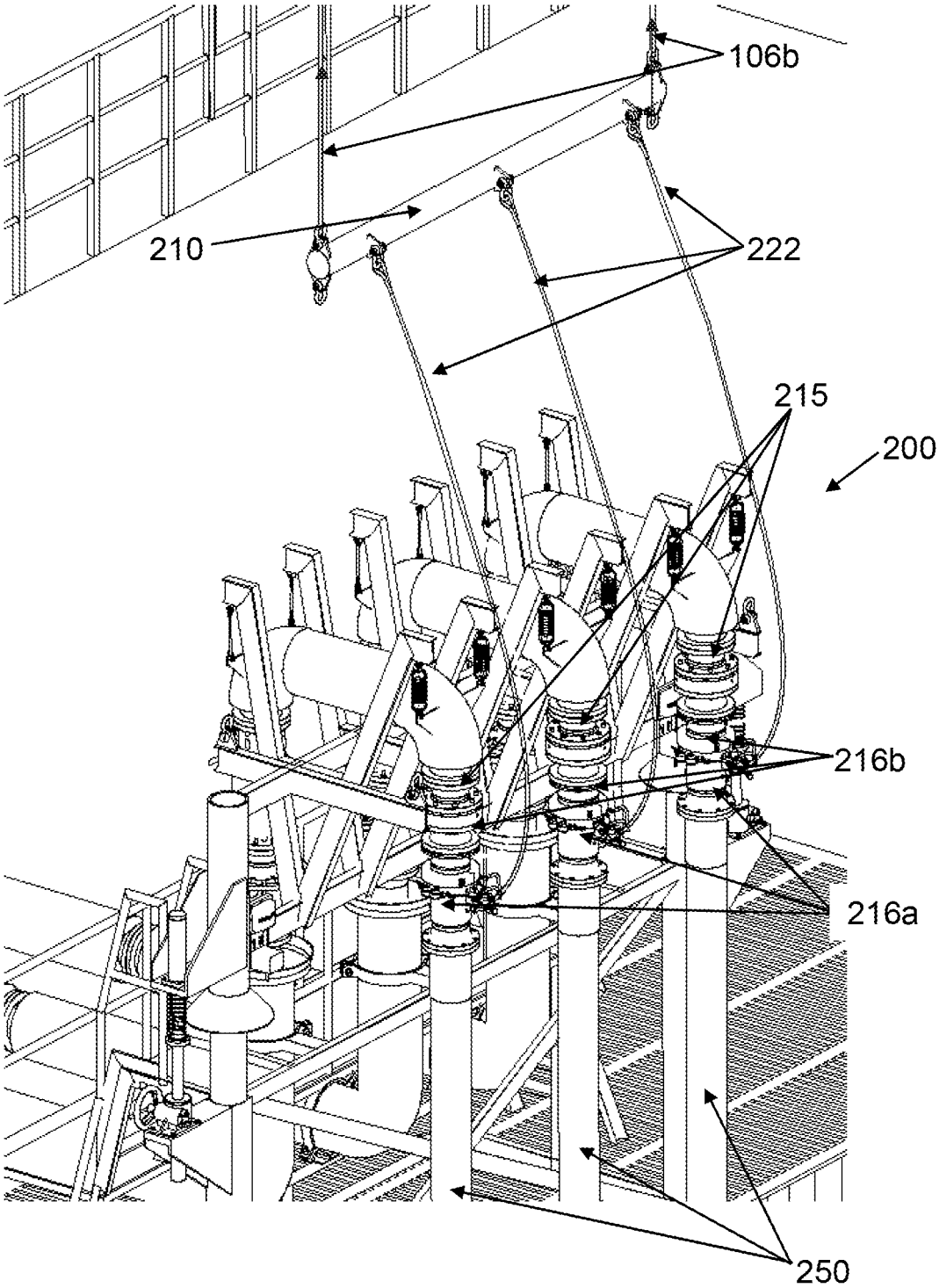
FIG. 12 illustrates the main hoist wires disconnected from the spreader beam and the guide wires disconnected from the mast.

The main hoist wires 106*b* may be further drawn down by the main hoist winches 106*a* until the skid hoist wires 211 are accessible, for example by crew members, on the working platform 304. The skid hoist wires 211 may be disconnected from the spreader beam 210; the guide wires 108*b* may be disconnected from the mast 100 (FIG. 12). However, the ERCs 216 remain connected to the spreader beam 210 by ERC hoist wires 222.

Figure 13:
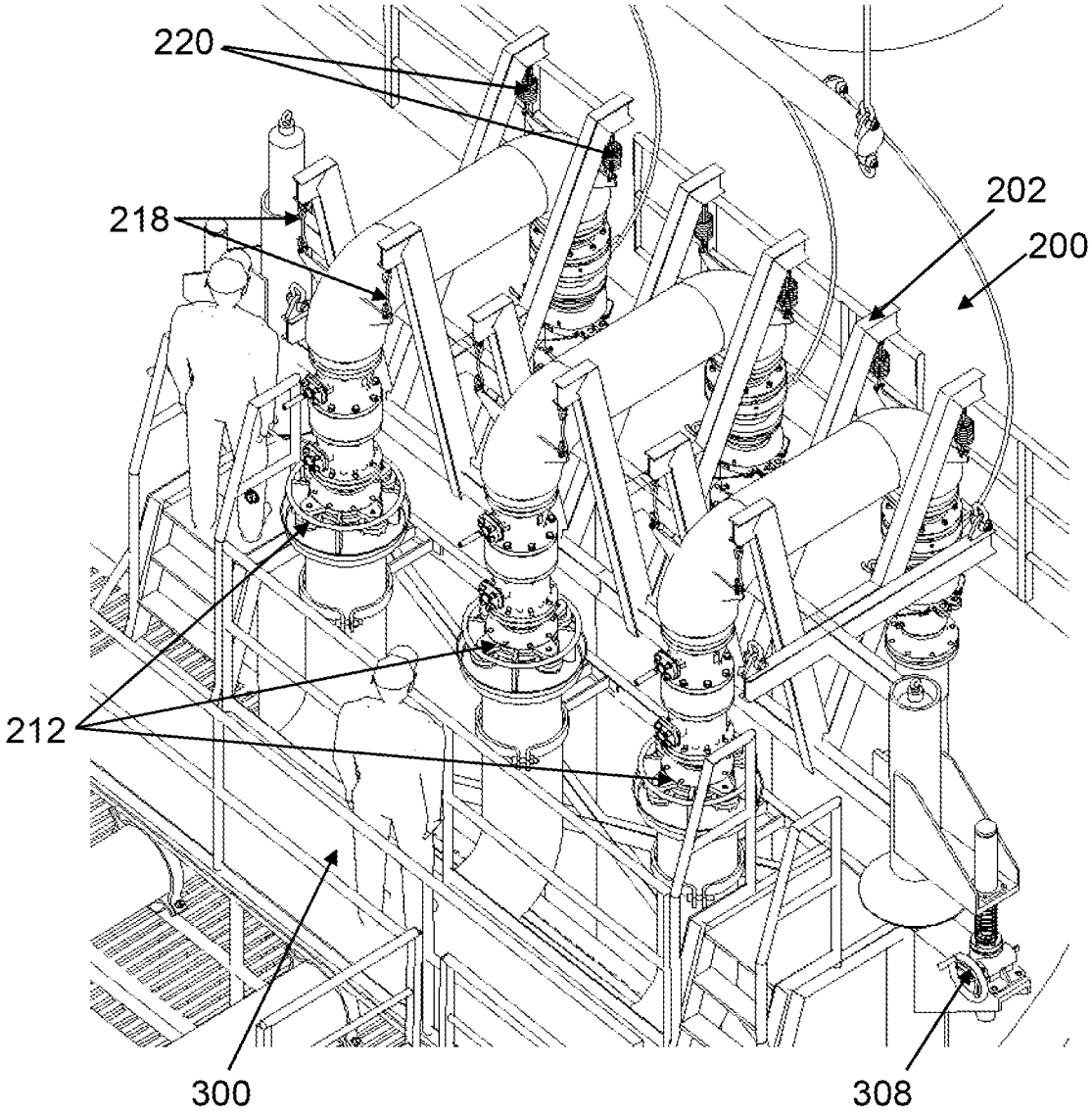
FIG. 13 illustrates the QCDCs of the transfer skids being locked or secured to the connecting flanges of the pipe spools at the pipe deck.

The jack screws 308 may be lowered down until each QCDC 212 contact its respective connecting flange (see FIG. 13). Fine adjustments to the alignment of the QCDC 212 to engage with the connecting flange may be performed since each pipe 204 of the transfer skid 200 is suspended by springs and/or wires to allow some degree of movement. The jack screws 308 maintain a safety gap between the QCDCs 212 of the transfer skid 200 and the connecting flanges during landing to prevent the QCDCs 212 from being damaged by landing impact forces. When the QCDCs 212 contact the connecting flanges, the wires 218 suspending the pipes 204 may slack. The tensional axial load of the pipes 204, including the weight of the hose, will be held by the springs 220 and the contact force at the QCDCs 212. Subsequently, cam locks of the QCDCs 212 may be activated to lock or secure the QCDCs 212 to the pipe spools 302.

At this stage, the transfer skid 200 is installed at the carrier vessel 20 in preparation for an offloading operation. The QCDCs 212 are disposed inboard the carrier vessel 20, e.g. above the main deck 26 of the carrier vessel 20, while the ERCs 216 are disposed outboard of the carrier vessel 20, e.g. exterior of the carrier vessel 20 and over the sea. This is possible as each QCDC 212 is spaced apart from an ERC 216 by a pipe 204 interposed or connected therebetween.

Figure 14:
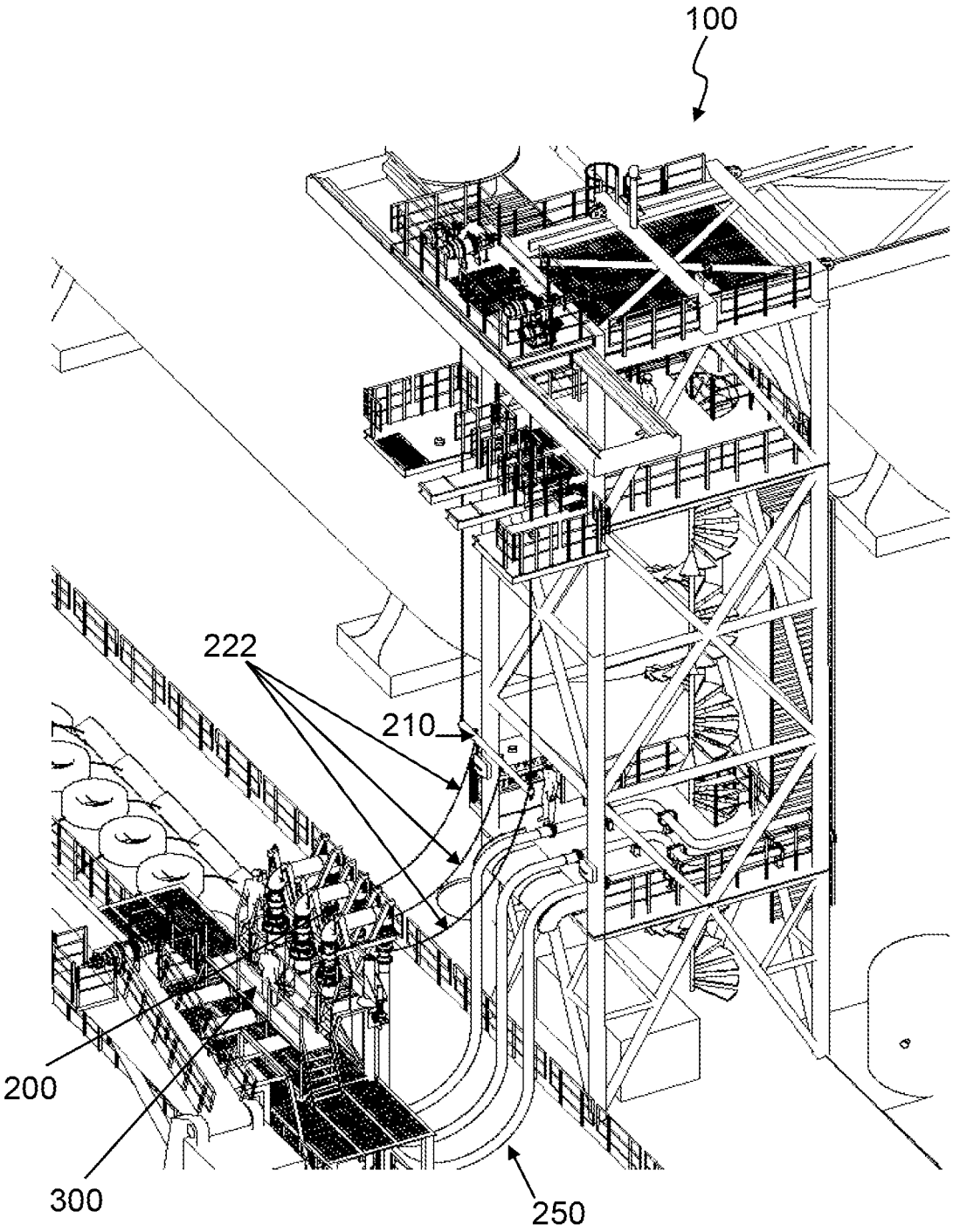
FIG. 14 illustrates an offloading operation.

Before commencing offloading operation, the gantry crane 104 may retract and the ERC hoist wires 222 connected to the spreader beam 210 may be allowed to slack (see FIG. 14). Other checks and procedures may take place as required. Offloading operation may then take place in which hydrocarbon fluid, e.g. liquefied natural gas (LNG), may be transferred from the carrier vessel 20 to the floating/fixed hydrocarbon facility 10 by way of transfer pumps. In FIG. 14, two transfer hoses 250 are configured for hydrocarbon fluid transfer while the remaining hose 250 is configured for vapour return. During offloading, transfer hoses 250 may be disposed outboard of the carrier vessel 20 and floating/fixed hydrocarbon facility 10 and hung in a catenary form. This way, less stress will be induced in the transfer hoses 250.

After the offloading operation is completed, various checks and procedures may take place to ensure that the hydrocarbon fluid transfer is ceased and it is safe to disconnect the transfer skid 200. In one embodiment where a double block valve is used, after transfer pumps are stopped, the upper valve of the double block valve may be closed to prevent leakage through the coupler and a nitrogen line will be provided to purge hydrocarbon fluid towards the carrier vessel 20. After purging, the lower valve of the double block valve as well as valves at the pipe spool 302 may be closed. Subsequently, the QCDCs 212 of the transfer skid 200 may be unlocked and safely disconnected from the pipe deck 300. The jack screws 308 may then be activated to lift up the transfer skid 200 to provide a clearance between the QCDCs 212 and connecting flanges to prevent accidental damage to the QCDC 212.

Figure 15A:
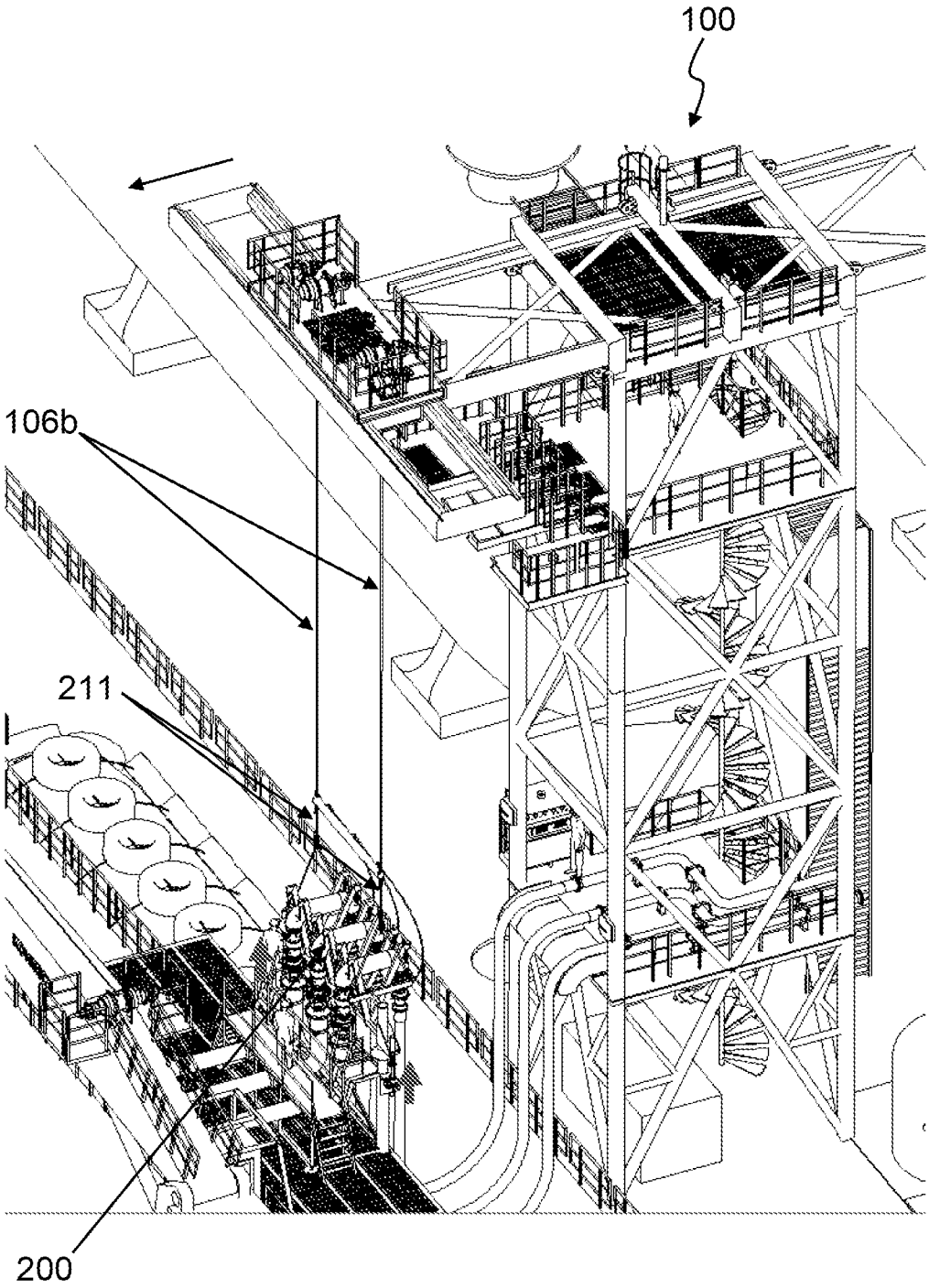
FIG. 15A illustrates the gantry crane extending towards the carrier vessel in preparation to retrieve the transfer skid.
Figure 15B:
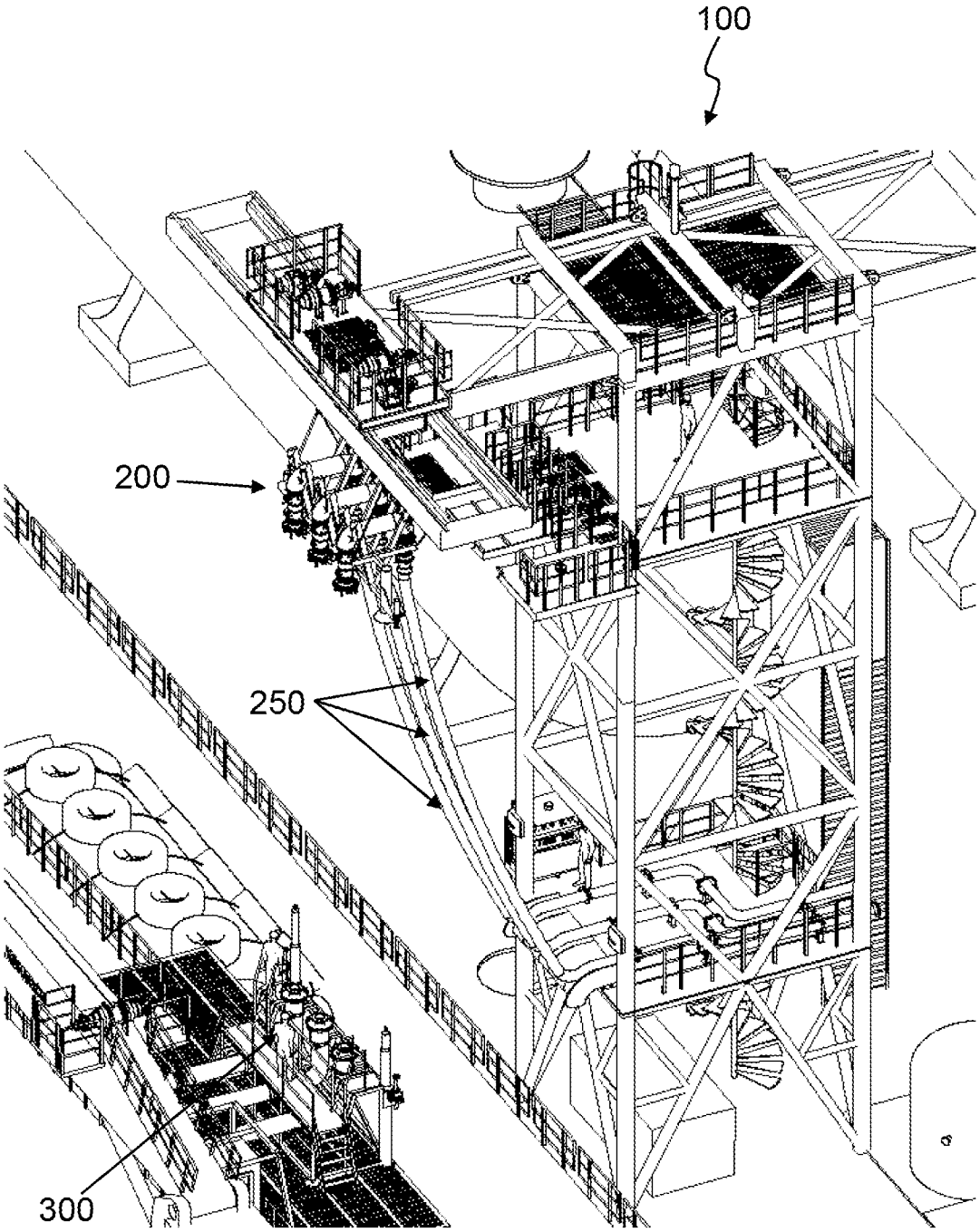
FIG. 15B illustrates the gantry crane hoisting the transfer skid and moving the transfer skid to the parking position on the mast.

Subsequently, the gantry crane 104 may extend towards the carrier vessel 20 in preparation to retrieve the uninstalled transfer skid 200 (see FIG. 15A). The main hoist wires 106*b* from the gantry crane 104 may be lowered and reconnected to the spreader beam 210. The gantry crane 104 may then hoist the transfer skid 200 and move or return the transfer skid 200 to the parking position on the mast 100 (see FIG. 15B). After the transfer skid 200 is disconnected from the pipe deck 300 of the carrier vessel 20, the carrier vessel 20 may be moved away as and when required.

Figure 16:
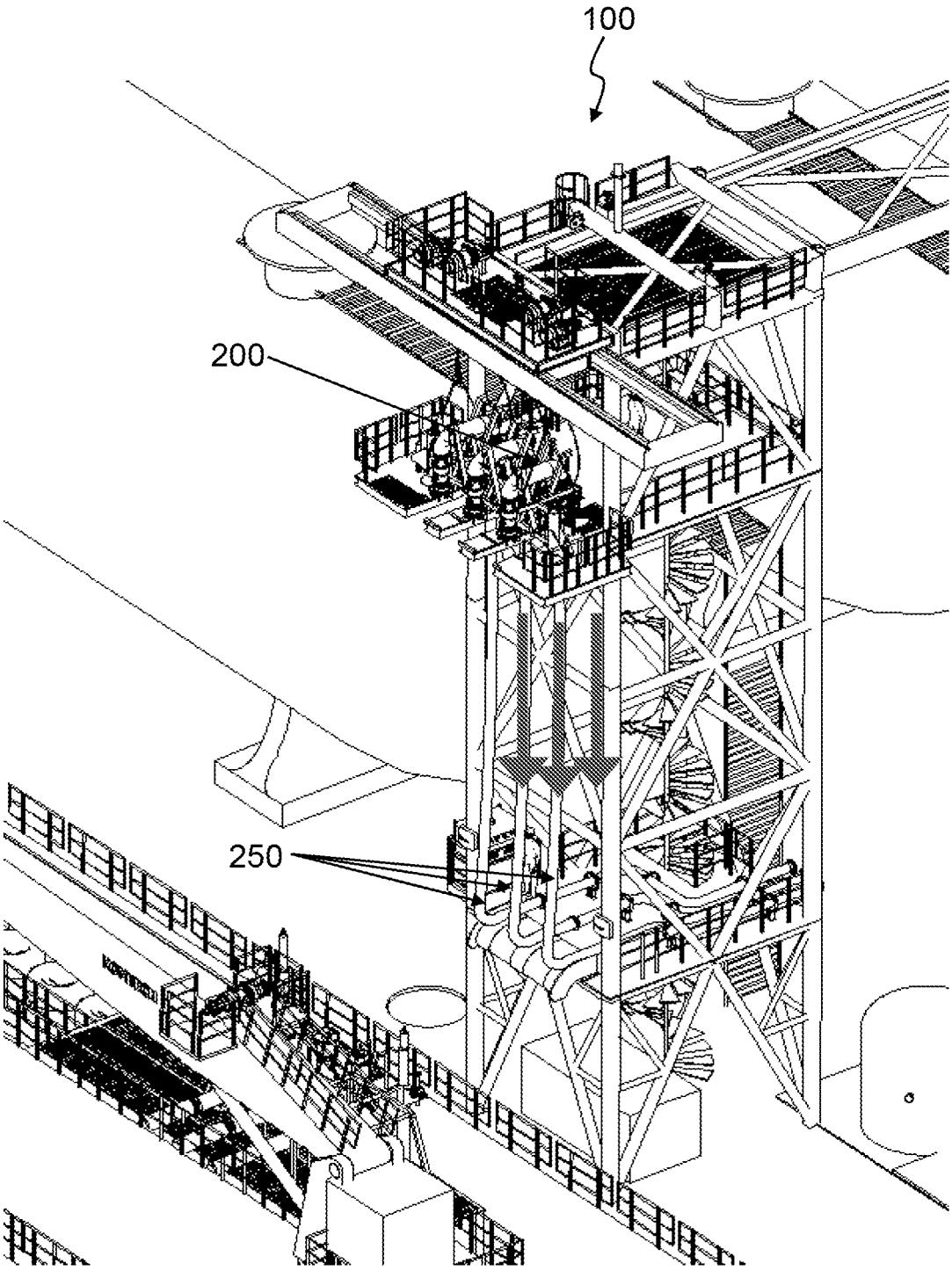
FIG. 16 illustrates draining of the transfer hoses at the parking position.

When the transfer skid 200 is returned to the parking position, hydrocarbon fluid in the transfer hoses 250 are allowed to drain by gravity (FIG. 16). Various checks and processes, e.g. purging, may take place to ensure all valves are sufficiently safe to be opened.

Emergency Situation and Emergency Release Operation

During the offloading operation, an emergency situation may occur that requires the transfer hoses 250 to separate or disconnect from the carrier vessel 20 safely and quickly. Examples of an emergency situation include, but are not limited to, extreme weather and environmental conditions causing carrier vessel 20 to drift away from the floating/fixed hydrocarbon facility 10, failure of mooring lines resulting in undesirable repositioning of the carrier vessel 20, and fire breakout.

Once the operating conditions are ascertained to have exceeded certain safe operating threshold, an Emergency Shut Down situation may be triggered in which transfer pumps are stopped and an Emergency Release System may be subsequently triggered to disconnect the transfer hoses 250 from the transfer skid 200 installed at the carrier vessel 20. Particularly, the ERCs 216 are activated to detach the parts 216*a*, 216*b* or connectors forming the ERC 216 (see FIG. 17). Once disconnected, the detached part 216*a* of each ERC 216 will fall away from the transfer skid 200 due to gravity force. As the ERC 216 is arranged outboard of the carrier vessel 20, the detached part 216*a* of each ERC 216 is allowed to free-fall together with the corresponding transfer hose 250 attached thereto.

Figure 17:
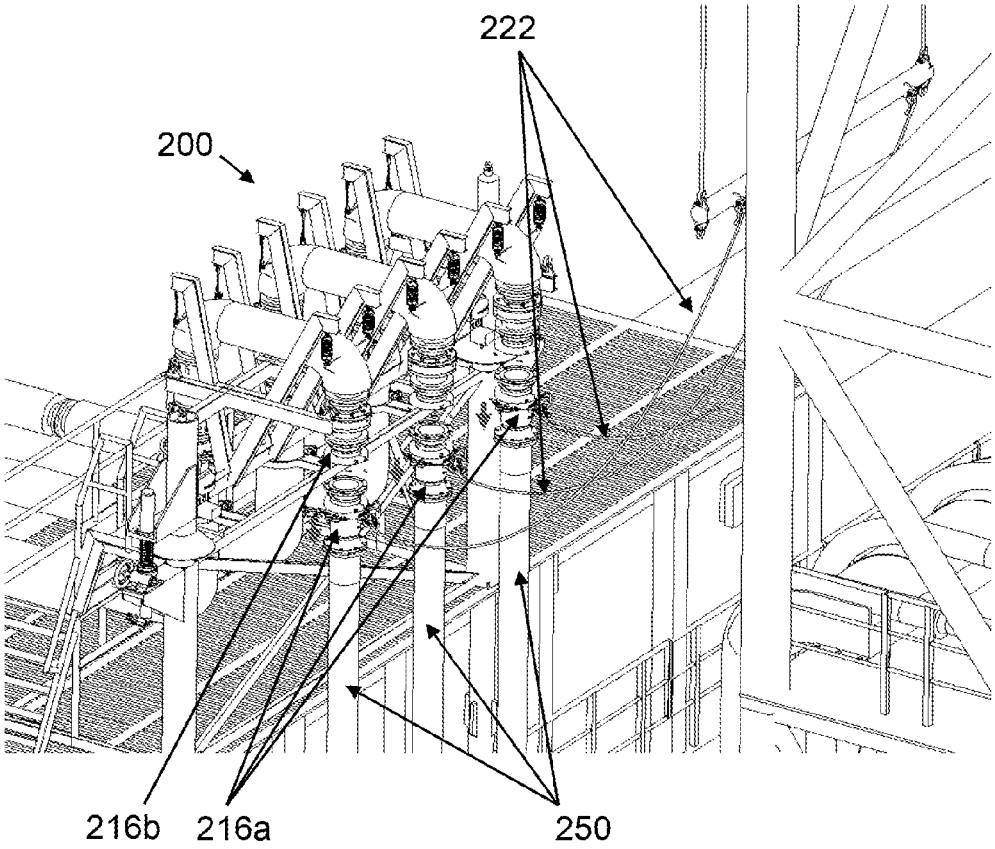
FIG. 17 illustrates disconnected halves of the ERC.
Figure 18:
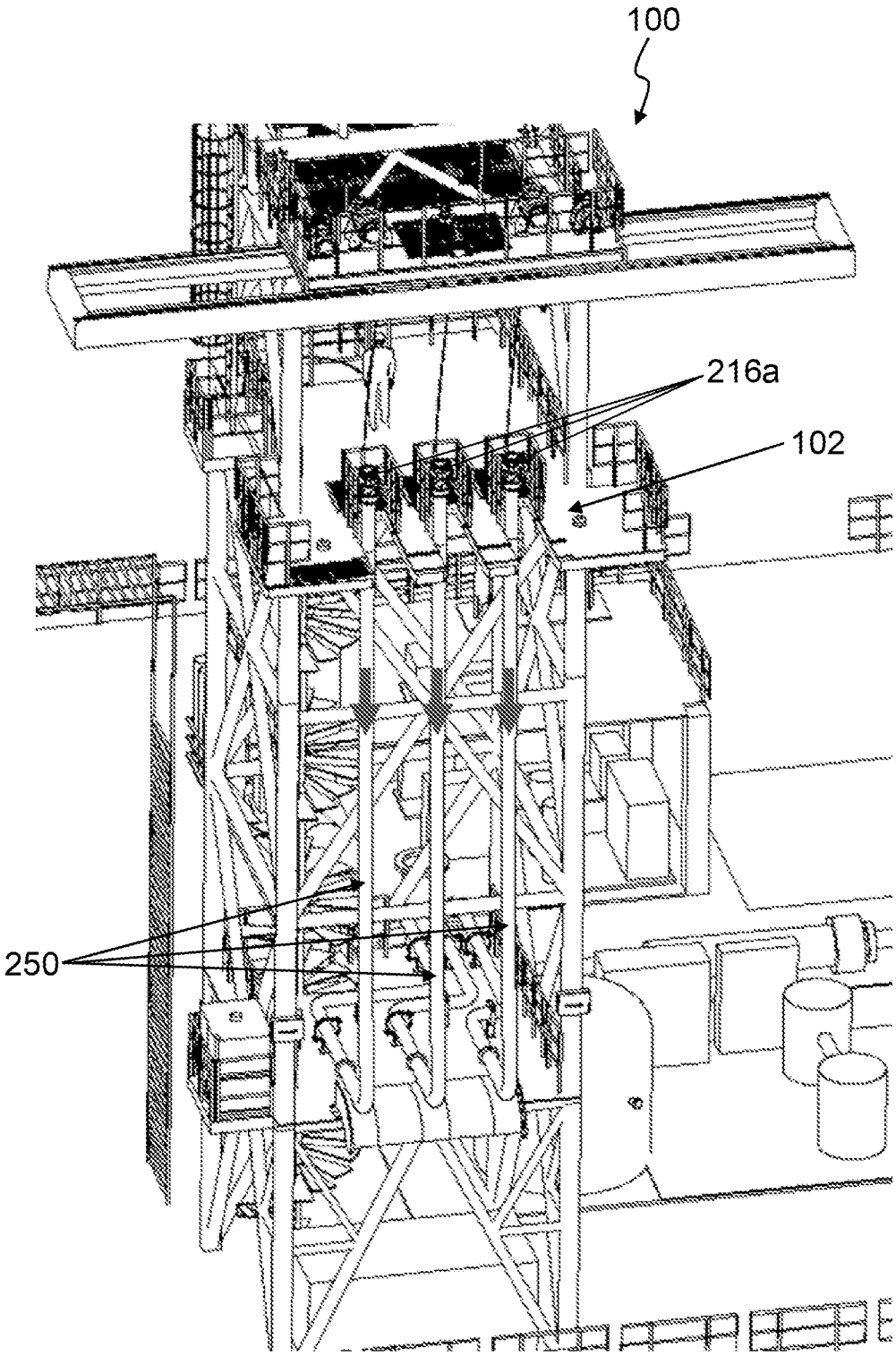
FIG. 18 illustrates the disconnected lower half of the ERCs and transfer hoses being moved to the parking platform at the mast.

However, the fall of the detached part 216*a* of the ERC 216 may be limited by a lifting device, e.g. gantry crane 104, supporting the detached part 216*a* of the ERC, where the lifting device may be provided on the first body. Particularly, as illustrated in FIG. 17, the detached part 216*a* of each ERC 216 is separately supported by an ERC hoist wire 222, which is attached to the spreader beam 210 which in turn remains supported by the lifting device provided on the floating/fixed hydrocarbon facility 10. Therefore, the fall of the detached part 216*a* of each ERC 216 is limited by the length of slack in the ERC hoist wire 222. Once the slack ERC hoist wires 222 become taut or fully extended, the detached part 216*a* of each ERC 216 is prevented from falling further. The detached part 216*a* of the ERCs 216 and transfer hoses 250 are then returned to the parking platform 102 at the floating/fixed hydrocarbon facility 10 by the lifting device or main hoist winches 106*a* (see FIG. 18). Draining and purging of the transfer hoses 250 may take place as a safety measure.

During the emergency release of the ERCs 216, the transfer skid 200, including pipes 204, QCDCs 212 and the other part 216*b* of the ERCs 216 which is attached to the QCDCs 212, will remain installed at the carrier vessel 20 until the emergency situation is brought under control or is resolved. Subsequently, a separate operation may be initiated to uninstall the transfer skid 200 from the carrier vessel 20 and move or return the transfer skid 200 to the floating/fixed hydrocarbon facility 10. Suitable procedures may take place to re-assemble the detached ERC parts 216*a*, 216*b* to prepare the transfer skid 200 for the next offloading operation.

In the foregoing description and accompanying drawings, the transfer skid 200 and ERCs 216, which are attached to a common spreader beam 210, are supported by a common lifting device. It is to be appreciated that suitable modifications may be made, e.g. the transfer skid 200 is supported by a first lifting device while the ERCs 216 are supported by a second lifting device where both first and second lifting devices may be operated from the floating/fixed hydrocarbon facility 10.

In the above-described offloading operation, emergency release operation and return of the detached ERCs 216 to the parked position, the transfer hoses 250 may be allowed to hang naturally in a catenary form.

Embodiments of the invention achieve various advantages such as but not limited to the following:

(1) If an emergency release is required during an offloading operation, the ERCs are disconnected thereby resulting in one halves of the ERCs and the corresponding transfer hoses detach from the transfer skid. The detached connector of each ERC and corresponding transfer hose may free fall up to a predetermined distance but are nonetheless supported by a spreader beam and lifting device or main hoist winches. The detached connector of each ERC may be moved or returned to the mast or parked position using the main hoist winches. Accordingly, when an emergency condition occurs, the carrier vessel may move away to safety upon detaching of the ERC. This results in a faster and safer emergency release operation.

(2) In various operations/positions including but not limited to, a parked position, offloading operation and emergency release operation, the transfer hoses are allowed to hang in a catenary form. This results in less stress in the flexible pipes.

(3) Spool pieces are connected to manifold flanges of the carrier vessel in certain embodiments. The spool pieces effectively move manifold flanges of the carrier vessel towards an outer edge of the carrier vessel, so that the ERC would be disposed outboard during offloading operation. If emergency release is required, the disconnected ERCs would free fall towards the sea and therefore would not result in hydrocarbon spill on the carrier or collision with the carrier vessel.

(4) Although the skid structure allow simultaneous transport of the multiple transfer devices and flexible pipes from a barge to a carrier vessel, each transfer device may be independently positioned and connected to the manifold flanges of carrier vessel or connection flanges at the spool pieces. This improves mating connection even if a deck of the carrier vessel supporting the manifold flanges or spool pieces is uneven or tilted.

(5) The skid structure supports multiple transfer devices so that transport of the transfer hoses together with the QCDCs and ERCs between two bodies is simultaneous and therefore efficient.

Other embodiments will be apparent to those skilled in the art from consideration of the specification and practice of the invention. Furthermore, certain terminology has been used for the purposes of descriptive clarity, and not to limit the disclosed embodiments of the invention. The embodiments and features described above should be considered exemplary, with the invention being defined by the appended claims.

The invention claimed is:

1. An offloading apparatus for facilitating hydrocarbon fluid transfer between two bodies, comprising:

a transfer skid which is pre-assembled prior to moving from a first body to a second body to be installed thereupon, the transfer skid comprising:

a skid frame;

a plurality of pipes, each of the pipes having a first end and a second distal end;

a coupler provided at the first end of the each of the pipes to connect to the second body upon installing the transfer skid;

an emergency release coupling provided at the second end of the each of the pipes; and a transfer hose connected between the emergency release coupling and the first body, wherein the pipes are separately attached to the skid frame by at least two adjustable support wires;

wherein one end of said support wire is adjustably attached to a portion of the pipe adjacent the first or second end of the pipe to allow the pipes to be repositioned relative to the skid frame and independently of one another for improving mating connection of the coupler of each of the pipes with a corresponding flange at the second body.

2. The offloading apparatus of claim 1, wherein the coupler and the emergency release coupling are arranged spaced apart so that upon installing the transfer skid onto the second body, the coupler is disposed inboard the second body while the emergency release coupling is disposed outboard of the second body.

3. The offloading apparatus of claim 2, wherein the emergency release coupling and an adjacent end of the transfer hose connected thereto are disposed in a vertical arrangement, and wherein the emergency release coupling disconnects the transfer hose from the transfer skid which is installed at the second body by way of detaching a part of the emergency release coupling, and allowing the detached part of the emergency release coupling, together with the transfer hose connected thereto, to fall away from the transfer skid due to gravity force.

4. The offloading apparatus of claim 3, wherein the detached part of the emergency release coupling is supported by a lifting device, which is provided on the first body, to limit the fall of the detached part of the emergency release coupling.

5. The offloading apparatus of claim 4, wherein the transfer hose maintains a catenary form during the fall of the detached part of the emergency release coupling by way of an attachment of the detached part of the emergency release coupling to a spreader beam which is supported by the lifting device.

6. The offloading apparatus of claim 1, wherein the transfer skid further comprises a swivel which is connected between the emergency release coupling and the coupler, wherein after installing the transfer skid on the second body, the transfer skid is rotatable relative to the second body by way of the swivel.

7. The offloading apparatus of claim 1, wherein the transfer skid further comprises at least one valve connected between each of the pipes and the coupler, wherein the at least one valve is closed during non-emergency release to allow the transfer skid, together with the transfer hose, return to a parking position on the first body for gravity-based draining without hydrocarbon fluid leakage through the coupler during the return to the first body.

8. The offloading apparatus of claim 1, wherein the transfer skid further comprises at least one valve which is integrated with the coupler and the each of the pipes, wherein the at least one valve is closed during non-emergency release to allow the transfer skid, together with the transfer hose, return to a parking position on the first body for gravity-based draining without hydrocarbon fluid leakage through the coupler during the return to the first body.

9. The offloading apparatus of claim 1, wherein the transfer skid is to receive at least one guide wire from the first body prior to installing the transfer skid onto the second body, wherein the guide wire is connected to the second body for guiding the transfer skid towards the second body, wherein the transfer skid further comprises at least one shock absorber to dampen impact during installing of the transfer skid onto the second body, and wherein the transfer skid is to receive a positioning device from the second body to allow adjustment of the transfer skid prior to locking the coupler.

10. The offloading apparatus of claim 1, wherein the transfer skid is moved from the first body to the second body by way of a lifting device provided on the first body, and a guiding device comprising of a plurality of winches and guide wires provided on the first body.

11. The offloading apparatus of claim 10, wherein the lifting device is one of a crane and a platform arrangement which is configured to move in a longitudinal and a transverse direction.

12. A method of transferring hydrocarbon fluid, the method comprising:

moving a pre-assembled transfer skid from a first body to a second body, wherein the transfer skid comprises:

a skid frame;

a plurality of pipes, each of the pipes having a first end and a second distal end;

a coupler provided at the first end of the each of the pipes to connect to the second body upon installing the transfer skid;

an emergency release coupling provided at the second end of the each of the pipes; and a transfer hose connected between the emergency release coupling and the first body, wherein the pipes are separately attached to the skid frame by at least two adjustable support wires;

wherein one end of said support wire is adjustably attached to a portion of the pipe adjacent the first or second end of the pipe to allow the pipes to be repositioned relative to the skid frame and independently of one another for improving mating connection of the coupler of each of the pipes with a corresponding flange at the second body;

manipulating the pipes independently of one another to position the pipes on the second body;

installing the transfer skid onto the second body to allow fluid communication between the first and the second body; and transferring hydrocarbon fluid from the first body to the second body or vice versa.

13. The method of claim 12, wherein the coupler and the emergency release coupling are arranged spaced apart, the method further comprising:

after installing of the transfer skid, having the coupler disposed inboard the second body and the emergency release coupling disposed outboard of the second body.

14. The method of claim 13, further comprising:

disconnecting the transfer hose from the transfer skid which is installed at the second body by detaching a part of the emergency release coupling, wherein the emergency release coupling and an adjacent end of the transfer hose connected thereto are disposed in a vertical arrangement prior to disconnecting; and allowing the detached part of the emergency release coupling, together with the transfer hose connected thereto, to fall away from the transfer skid due to gravity force.

15. The method of claim 14, further comprising:

limiting the fall of the detached part of the emergency release coupling by having the detached part of the emergency release coupling supported by a lifting device which is provided on the first body.

16. The method of claim 15, further comprising:

having the transfer hose maintain a catenary form during the fall of the detached part of the emergency release coupling by way of an attachment of the detached part of the emergency release coupling to a spreader beam which is supported by the lifting device.

17. The method of claim 12, further comprising:

after installing the transfer skid on the second body, allowing the transfer skid to rotate relative to the second body by way of a swivel which is connected between the each of the pipes and the emergency release coupling.

18. The method of claim 12, further comprising:

during non-emergency release, closing at least one valve, which is connected between the each of the pipes and the coupler, to prevent hydrocarbon fluid leakage through the coupler; and returning the transfer skid, together with the transfer hose, to a parking position on the first body for gravity-based draining.

19. The method of claim 12, further comprising:

during non-emergency release, closing at least one valve, which is integrated with the coupler, to prevent hydrocarbon fluid leakage through the coupler; and returning the transfer skid, together with the transfer hose, to a parking position on the first body for gravity-based draining.

20. The method of claim 12, further comprising:

prior to installing the transfer skid onto the second body, having the transfer skid receive at least one guide wire from the first body wherein the guide wire is connected to the second body for guiding the transfer skid towards the second body;

dampening impact during installing of the transfer skid onto the second body by way of at least one shock absorber provided at the transfer skid; and adjusting the transfer skid prior to locking the coupler by way of a positioning device.

21. The method of claim 12, further comprising:

moving the transfer skid from the first body to the second body by way of a lifting device provided on the first body, and a guiding device comprising of a plurality of winches and guide wires provided on the first body.

22. The method of claim 21, wherein the lifting device is one of a crane and a platform arrangement which is configured to move in a longitudinal and a transverse direction.

* * * * *